US005592891A

United States Patent [19]

Muto

[11] Patent Number: 5,592,891

[45] Date of Patent: Jan. 14, 1997

[54] EMBROIDERY DATA PROCESSING APPARATUS AND PROCESS OF PRODUCING AN EMBROIDERY PRODUCT

[75] Inventor: Yukiyoshi Muto, Nagoya, Japan

[73] Assignee: Brother Kogyo Kabushiki Kaisha, Aichi-ken, Japan

[21] Appl. No.: 633,480

[22] Filed: Apr. 17, 1996

[30] Foreign Application Priority Data

Apr. 28, 1995 [JP] Japan ..... 7-105159

[51] Int. Cl.[6] ..... D05C 9/06; D05B 21/00

[52] U.S. Cl. ..... 112/475.19; 112/102.5; 364/470.09

[58] Field of Search ..... 112/475.19, 475.18, 112/470.06, 102.5, 470.04, 454, 456, 458, 78; 364/470

[56] References Cited

U.S. PATENT DOCUMENTS

| | | | |
|---|---|---|---|
| 5,189,622 | 2/1993 | Hayakawa et al. | 112/102.5 |
| 5,299,514 | 4/1994 | Hayakawa et al. | 112/102.5 |
| 5,474,000 | 12/1995 | Mizuno et al. | 112/102.5 |

*Primary Examiner*—Peter Nerbun
*Attorney, Agent, or Firm*—Oliff & Berridge

[57] ABSTRACT

An apparatus for processing embroidery data needed to control a sewing machine to form an embroidery pattern on a work sheet, the apparatus including an outline-data memory which stores original-outline data representing at least one original outline of an original embroidery pattern, the original outline including a plurality of segments, a reference-vector memory which stores data indicative of a reference vector specifying a reference direction and a reference length, and a shadow-pattern embroidery-data producing device for producing, based on the original-outline data and the reference vector, shadow-pattern embroidery data needed to control the sewing machine to form stitches of at least one shadow embroidery pattern which is contiguous with the original embroidery pattern and whose outline is defined by at least one of the segments of the original outline and at least one of two straight width-defining segments which extend in the reference direction from opposite two ends of the one segment, respectively, and each of which has the reference length defining a width of the shadow embroidery pattern in the reference direction.

30 Claims, 14 Drawing Sheets

$\vec{U} = (Ux, Uy)$ $\vec{V} = (Vx, Vy)$ $\vec{U} = (U_x, U_y)$ : SHADOW VECTOR $\vec{V} = (V_x, V_y)$ : VECTOR FROM POINT $P_n$ TO POINT $P_{n+1}$ $\theta$ : ANGLE MEASURED IN CLOCKWISE DIRECTION FROM VECTOR $\vec{V}$ TO VECTOR $\vec{U}$

MEMORY 24

| | | | | | | |
|---|---|---|---|---|---|---|
| FEED 1 | BLOCK 3 | BLOCK 4 | FEED 2 | BLOCK 5 | FEED 3 | |

ORIGINAL-PATTERN EMBROIDERY

SHADOW-PATTERN EMBROIDERY

EMBROIDERY DATA PROCESSING APPARATUS AND PROCESS OF PRODUCING AN EMBROIDERY PRODUCT

BACKGROUND OF THE INVENTION

1. Field of the Invention

The present invention relates to an embroidery data processing apparatus which processes embroidery data needed to control a sewing machine to form an embroidery pattern on one or more work sheets, and in particular to such an apparatus for processing embroidery data which command a sewing machine to form a shadowed embroidery pattern including an original embroidery pattern and one or more shadow embroidery patterns.

2. Related Art Statement

There is known an embroidering manner, shown in FIG. 14, in which a "shadowed" embroidery pattern is produced by forming, using a sewing thread with a light color, embroidery stitches of an original embroidery pattern, a, such as an alphabet character, and forming, using another sewing thread with a darker color, embroidery stitches of one or more "shadow" embroidery patterns, b, which are contiguous with the original pattern a. The produced shadowed embroidery pattern a, b exhibits a good three-dimensional effect to observers.

A first conventional method, shown in FIG. 15, in which a shadowed embroidery pattern is produced is to embroider a selected pattern, subsequently change the position of an embroidery frame, or a work sheet held by the frame, relative to a sewing needle, and embroider the same pattern once more.

A second conventional method is to produce, as embroidery data to be supplied to a sewing machine, shadowed-pattern embroidery data including original-pattern embroidery data corresponding to an original embroidery pattern and shadow-pattern embroidery data corresponding to one or more shadow embroidery patterns. The second method may be carried out by an embroidery data processing apparatus which is essentially provided by a microcomputer and is equipped with an image scanner, a display, a mouse, etc. When an operator or user inputs, in the processing apparatus, sets of coordinate values defining the outline of a shadow embroidery pattern, the processing apparatus divides, based on the input data, the inside area of the shadow embroidery pattern bounded by the outline thereof, into quadrangular and/or triangular blocks, according to a known outline-defining-data processing algorithm, and produces, as shadow-pattern embroidery data, sets of block-defining data defining respective quadrangular and/or triangular outlines of the blocks. Otherwise, an operator may directly input, as shadow-pattern embroidery data, sets of coordinate values defining stitch positions, in the processing apparatus.

However, the first method in which the same pattern is embroidered twice suffers from the problems that the quality of embroidery is low because the two patterns overlap each other in a large area and that two-fold amounts of time and thread are needed. In addition, a produced shadowed embroidery pattern lacks stitches to fill areas, c, shown in FIG. 15. Moreover, the stitches of the shadow embroidery pattern do not extend all in the same direction and accordingly the shadowed embroidery pattern cannot enjoy a three-dimensional effect.

The second method requires the operator to input, in the processing apparatus, sets of coordinate values defining the outline of each shadow pattern, by using the mouse, etc., so that the processing apparatus may produce shadow-pattern embroidery data based on the input data, or to directly input, as shadow-pattern embroidery data, sets of coordinate values defining stitch positions where a sewing needle of a sewing machine penetrates a work sheet. However, it is cumbersome for the operator to input sets of coordinate values in the processing apparatus, and it takes a long time to obtain shadowed-pattern embroidery data.

SUMMARY OF THE INVENTION

It is therefore a first object of the present invention to provide an embroidery data processing apparatus which automatically produces shadow-pattern embroidery data based on outline data defining one or more outlines of an original embroidery pattern and data indicative of a reference vector specifying a reference direction and a reference length.

It is a second object of the present invention to provide a process of producing an embroidery product according to shadowed-pattern embroidery data including original-pattern embroidery data and shadow-pattern embroidery data.

It is a third object of the present invention to provide a recording medium in which a embroidery-control program is recorded which is readable by a computer and usable to control the computer to process shadow-pattern embroidery data.

The first object has been achieved according to a first aspect of the present invention, which provides an apparatus for processing embroidery data needed to control a sewing machine to form an embroidery pattern on a work sheet, the apparatus comprising an outline-data memory which stores original-outline data representing at least one original outline of an original embroidery pattern, the original outline including a plurality of segments; a reference-vector memory which stores data indicative of a reference vector specifying a reference direction and a reference length; and shadow-pattern embroidery-data producing means for producing, based on the original-outline data and the reference vector, shadow-pattern embroidery data needed to control the sewing machine to form stitches of at least one shadow embroidery pattern which is contiguous with the original embroidery pattern and whose outline is defined by at least one of the segments of the original outline and at least one of two straight width-defining segments which extend in the reference direction from opposite two ends of the one segment, respectively, and each of which has the reference length defining a width of the shadow embroidery pattern in the reference direction.

In the embroidery data processing apparatus constructed as described above, the shadow-pattern embroidery-data producing means produces, based on the original-outline data and the reference vector, the shadow-pattern embroidery data needed to control the sewing machine to form the stitches of one or more shadow embroidery patterns. Therefore, an operator or user is released from the burden of inputting data defining the outline of each shadow pattern by using a mouse, etc. Thus, the present apparatus easily and quickly produces shadow-pattern embroidery data. In the case where the present apparatus includes a display for displaying the original outline of the original embroidery pattern, the operator may select one or more from the segments of the original outline, so that the present apparatus automatically produces the shadow-pattern embroidery data based on the selected segment and the reference vector.

Each segment of the original outline may be a straight or a curved one.

According to a preferred feature of the first aspect of the invention, the processing apparatus further comprises original-pattern embroidery-data producing means for producing, based on the original-outline data, original-pattern embroidery data needed to control the sewing machine to form the original embroidery pattern by filling, with stitches, a closed embroidery area bounded by the original outline thereof; and shadowed-pattern embroidery-data producing means for producing, based on the shadow-pattern embroidery data and the original-pattern embroidery data, shadowed-pattern embroidery data needed to form a shadowed embroidery pattern including the original and shadow embroidery patterns, such that the shadow embroidery pattern is formed prior to the formation of the original embroidery pattern. Even in the case where the shadow embroidery pattern includes an overlapping portion which overlaps the original embroidery pattern, the shadow pattern is formed prior to, i.e., under the original pattern, so that the shadowed embroidery pattern enjoys an excellent appearance.

According to another feature of the first aspect of the invention, the shadowed-pattern embroidery-data producing means comprises means for producing the shadowed-pattern embroidery data including a plurality of sets of block data each set of which represents a quadrangle as an outline of a corresponding one of a plurality of blocks obtained by dividing the shadowed embroidery pattern including the original and shadow embroidery patterns. A sewing machine may form the stitches of the shadowed embroidery pattern, based on the sets of block data and stitch-number data indicative of a number of stitches to be formed in each block. The stitch-number data may be replaced by stitch-density data indicative of a number of stitches to be formed in unit length. The sets of block data may include one or more sets of block data each set of which represents a triangle as the outline of a corresponding block.

According to another feature of the first aspect of the invention, the shadowed-pattern embroidery-data producing means comprises means for producing the shadowed-pattern embroidery data including a plurality of sets of stitch-position data each set of which represents a position where a sewing needle of the sewing machine penetrates the work sheet to form a stitch of the shadowed embroidery pattern including the original and shadow embroidery patterns. Each set of stitch-position data may be a set of x and y coordinate values, or a set of vector data.

According to another feature of the first aspect of the invention, the shadow-pattern embroidery-data producing means comprises means for producing the shadow-pattern embroidery data needed to form the stitches of the shadow embroidery pattern such that each of the formed stitches extends substantially parallel to the reference direction. In this case, the stitches of the shadow embroidery pattern give an excellent three-dimensional effect to the shadowed embroidery pattern as a whole, thereby improving the quality of the embroidery product. The stitches of the shadow embroidery pattern are preferably formed with a sewing thread with a first color different from a second color of a sewing thread used to form the stitches of the original embroidery pattern. It is preferred that the first color be darker than the second color.

According to another feature of the first aspect of the invention, the processing apparatus further comprises original-pattern embroidery-data producing means for producing, based on the original-outline data, original-pattern embroidery data needed to control the sewing machine to form stitches of the original embroidery pattern such that the stitches of the original embroidery pattern comprise stitches extending in a direction different from a direction in which the stitches of the shadow embroidery pattern extend. The original embroidery pattern may consist of stitches extending in a direction or directions different from the direction in which the stitches of the shadow embroidery pattern extend. Thus, the shadow embroidery pattern gives an excellent three-dimensional effect to the shadowed embroidery pattern as a whole.

According to another feature of the first aspect of the invention, the shadow-pattern embroidery-data producing means comprises means for producing, based on the reference vector and the original-outline data representing the original outline including a straight segment as the one segment thereof, the shadow-pattern embroidery data needed to form the shadow embroidery pattern whose outline is defined by the straight segment of the original outline and the one width-defining segment.

According to another feature of the first aspect of the invention, the shadow-pattern embroidery-data producing means comprises means for producing, based on the reference vector and the original-outline data representing the original outline including a straight segment as the one segment thereof, the shadow-pattern embroidery data needed to form the shadow embroidery pattern whose outline consists of a parallelogram defined by the straight segment of the original outline and the one width-defining segment.

According to another feature of the first aspect of the invention, the shadow-pattern embroidery-data producing means comprises means for producing, based on the reference vector and the original-outline data representing the original outline including a curved segment as the one segment thereof, the shadow-pattern embroidery data needed to form the shadow embroidery pattern whose outline is defined by the curved segment of the original outline and the one width-defining segment. The curved segment may be a Bezier curve, an arc, a portion of an ellipse, etc.

According to another feature of the first aspect of the invention, the shadow-pattern embroidery-data producing means comprises means for producing, based on the reference vector and the original-outline data representing the original outline including a curved segment as the one segment thereof, the shadow-pattern embroidery data needed to form the shadow embroidery pattern whose outline is defined by the curved segment of the original outline and the two width-defining segments.

According to another feature of the first aspect of the invention, the shadow-pattern embroidery-data producing means comprises means for modifying, based on the original outline data and a shadow-outline data representing the outline of the shadow embroidery pattern, the shadow-pattern embroidery data which command the sewing machine to form the shadow embroidery pattern including an overlapping portion which overlaps the original embroidery pattern, into modified shadow-pattern embroidery data which do not command the sewing machine to form stitches in the overlapping portion. The shadow-pattern embroidery-data producing means may additionally include identifying means for identifying the overlapping portion of the shadow embroidery pattern, based on the original outline data and the shadow-outline data. In either case, the shadow embroidery pattern may be formed after the formation of the original embroidery pattern.

According to another feature of the first aspect of the invention, the outline-data memory stores the original-outline data including a plurality of sets of segment data defining, as the segments, a plurality of straight segments in an order such that when the straight segments are traced in the order, the original sewing pattern exists on a left-hand side of each of the straight segments, and the shadow-pattern embroidery-data producing means comprises judging means for judging whether an angle measured from the each straight segment to the reference vector in a clockwise direction falls within a range of 0 to 180 degrees, and means for producing, when the judging means makes a positive judgment, the shadow-pattern embroidery data needed to form the shadow embroidery pattern whose outline consists a parallelogram defined by the each straight segment and the one width-defining segment. Even in the case where the shadow pattern includes an overlapping portion overlapping the original pattern, the area of the overlapping portion is considerably small.

According to another feature of the first aspect of the invention, the outline-data memory stores the original-outline data including a plurality of sets of segment data defining, as the segments, a plurality of straight segments in an order such that when the straight segments are traced in the order, the original sewing pattern exists on a right-hand side of each of the straight segments, and the shadow-pattern embroidery-data producing means comprises judging means for judging whether an angle measured from the each straight segment to the reference vector in a counterclockwise direction falls within a range of 0 to 180 degrees, and means for producing, when the judging means makes a positive judgment, the shadow-pattern embroidery data needed to form the shadow embroidery pattern whose outline consists a parallelogram defined by the each straight segment and the one width-defining segment.

According to another feature of the first aspect of the invention, the outline-data memory stores the original-outline data representing the original outline including a curved segment as the one segment thereof, and the shadow-pattern embroidery-data producing means comprises means for determining at least one tangent segment which is tangent to the curved segment, extends from a point on the curved segment in the reference direction, and has the reference length, and producing the shadow-pattern embroidery data needed to form the shadow embroidery pattern whose outline is defined by the curved segment and the one tangent segment. Regarding a curved segment, the angle contained by the curved segment and the reference vector changes when the curved segment is traced from one end there of toward the other end thereof. The angle contained by the reference vector and a tangent segment is 0 degree or 180 degrees. Thus, it is important to determine one or two straight segments tangent to a curved segment.

According to another feature of the first aspect of the invention, the shadow-pattern embroidery-data producing means comprises means for, when a shadow embroidery pattern is formed contiguously with each of a first and a third one of at least three successive segments out of the plurality of segments of the original outline and no shadow embroidery pattern is formed for a second one of the three segments which is intermediate between the first and third segments, producing the shadow-pattern embroidery data including a set of shadow-pattern connecting data needed to control the sewing machine to move at least one of a sewing needle thereof and the work sheet relative to each other, so as to connect, with a sewing thread conveyed by the sewing needle, between a position in the shadow embroidery pattern for the first segment and a position in the shadow embroidery pattern for the third segment. A set of shadow-pattern connecting data may be either a set of feed data which commands the sewing machine to move the work sheet relative to the sewing needle, without forming any stitches between the two shadow patterns, or a set of guide-line data needed to form one or more connecting stitches along a guide line, represented by the data, within the embroidery area bounded by the original outline. In this case, the connecting stitches are covered by the stitches of the original outline.

According to another feature of the first aspect of the invention, the processing apparatus further comprises a utilizing device which utilizes the shadowed-pattern embroidery data to control the sewing machine to form the shadowed embroidery pattern including the original and shadow embroidery patterns on the work sheet.

According to another feature of the first aspect of the invention, the utilizing device comprises a stitch-forming device of the sewing machine which forms stitches of the shadowed embroidery pattern including the original and shadow embroidery patterns on the work sheet.

According to another feature of the first aspect of the invention, the utilizing device comprises a data recording device which records, in an external memory, the shadowed-pattern embroidery data to control the sewing machine to form the shadowed embroidery pattern on the work sheet. The external memory may be, e.g., a floppy disk or a flash-memory card.

According to another feature of the first aspect of the invention, the processing apparatus further comprises a data obtaining device which obtains the original-outline data and stores the obtained data in the outline-data memory. The data obtaining device may be an image detector such as an image scanner, a data reading device for reading image data from an external memory, or an input device operable for inputting image data into the processing apparatus. The input device may include a display, a keyboard, and/or a mouse.

According to another feature of the first aspect of the invention, the processing apparatus further comprises a data obtaining device which obtains the data indicative of the reference vector and stores the obtained data in the reference-vector memory. The data obtaining device may be a selecting device for selecting, as the reference vector, one of a plurality of pre-stored reference vectors, or an input device operable for inputting a desired vector as the reference vector. However, the reference vector may be pre-stored as default data in the reference-vector memory. In the latter case, the data obtaining device may be omitted.

The second object has been achieved according to a second aspect of the present invention, which provides a process of producing an embroidery product by forming an embroidery pattern on a work sheet, the process comprising the steps of producing, based on original-outline data representing at least one original outline of an original embroidery pattern, and data indicative of a reference vector specifying a reference direction and a reference length, shadowed-pattern embroidery data needed to control a sewing machine to form stitches of a shadowed embroidery pattern including the original embroidery pattern and at least one shadow embroidery pattern which is contiguous with the original embroidery pattern and whose outline is defined by at least one of a plurality of segments of the original outline and at least one of two straight width-defining segments which extend in the reference direction from opposite two ends of the one segment, respectively, and each of which has the reference length defining a width of the shadow embroidery pattern in the reference direction, and operating a computer of the sewing machine to control, according to the produced shadowed-pattern embroidery data, a stitch-forming device of the sewing machine to form the stitches of the shadowed embroidery pattern on the work sheet and thereby produce the embroidery product.

The embroidery-product producing process in accordance with the second aspect of the invention provides an embroidery product having a shadowed embroidery pattern which enjoys an excellent three-dimensional effect.

According to a preferred feature of the second aspect of the invention, the producing process further comprises the step of storing, in an outline-data memory, the original-outline data representing the original outline including, as the at least one segment thereof, at least one of a straight segment and a curved segment.

According to another feature of the second aspect of the invention, the producing process further comprises the step of storing, in a reference-vector memory, the data indicative of the reference vector.

According to another feature of the second aspect of the invention, the producing process further comprises the step of recording the shadowed-pattern embroidery data in an external memory, and the step of operating the computer of the sewing machine comprises operating the computer of the sewing machine to control, according to the shadowed-pattern embroidery data recorded in the external memory, the stitch-forming device of the sewing machine to form the stitches of the shadowed embroidery pattern on the work sheet and thereby produce the embroidery product.

The third object has been achieved according to a third aspect of the present invention, which provides a recording medium in which an embroidery-control program is recorded which is readable by a computer and usable to control the computer to process embroidery data according to which a sewing machine forms an embroidery pattern on a work sheet, the program comprising steps of obtaining original-outline data representing at least one original outline of an original embroidery pattern, the original outline including a plurality of segments, obtaining data indicative of a reference vector specifying a reference direction and a reference length, and producing, based on the original-outline data and the reference vector, shadow-pattern embroidery data according to which the sewing machine forms stitches of at least one shadow embroidery pattern which is contiguous with the original embroidery pattern and whose outline is defined by at least one of the segments of the original outline and at least one of two straight width-defining segments which extend in the reference direction from opposite two ends of the one segment, respectively, and each of which has the reference length defining a width of the shadow embroidery pattern in the reference direction.

In the recording medium in accordance with the third aspect of the invention, the embroidery-control program is recorded which is readably by a computer, such as a personal computer owned by a user of a sewing machine, to control the computer to produce shadow-pattern embroidery data. Thus, the user can easily and quickly obtain the shadow-pattern embroidery data and utilize the embroidery data to operate the sewing machine to form the embroidery pattern on the work sheet.

According to a preferred feature of the third aspect of the invention, the program recorded in the medium further comprises the steps of producing, based on the original-outline data, original-pattern embroidery data according to which the sewing machine forms the original embroidery pattern by filling, with stitches, a closed embroidery area bounded by the original outline thereof, and producing, based on the shadow-pattern embroidery data and the original-pattern embroidery data, shadowed-pattern embroidery data according to which the sewing machine forms a shadowed embroidery pattern including the original and shadow embroidery patterns, such that the shadow embroidery pattern is formed prior to the formation of the original embroidery pattern.

According to another feature of the third aspect of the invention, the step of producing the shadow-pattern embroidery data comprises producing the shadow-pattern embroidery data according to which the sewing machine forms the stitches of the shadow embroidery pattern such that each of the formed stitches extends substantially parallel to said reference direction.

BRIEF DESCRIPTION OF THE PREFERRED EMBODIMENTS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

There will be described an embroidery data processing apparatus 1 to which the present invention is applied, by reference to FIGS. 1A through 11. The present processing apparatus 1 processes embroidery data which are supplied to a domestic or home-use embroidery sewing machine 14 shown in FIG. 1B.

Figure 14:
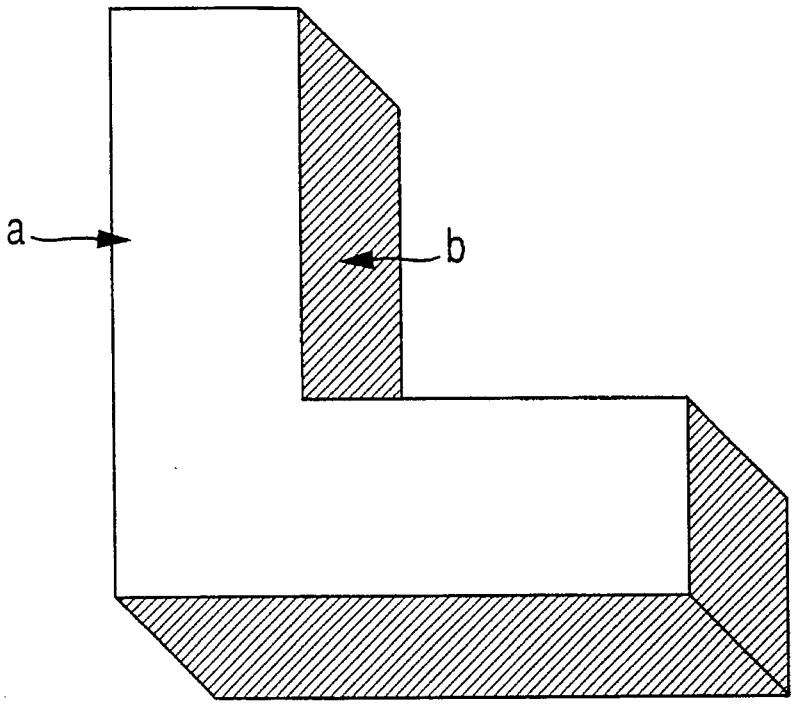
FIG. 14 is a view for illustrating an embroidering manner in which a shadowed embroidery pattern is produced.
Figure 15:
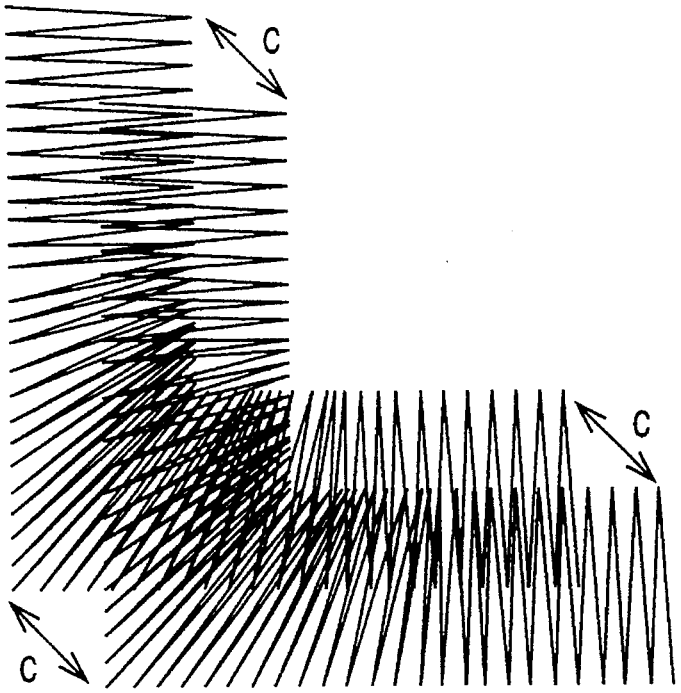
FIG. 15 PRIOR ART
FIG. 15 is a view of a shadowed embroidery pattern produced in a conventional embroidering method.

The processing apparatus 1 includes, as an image input device, an image scanner 5 which is manually operable by an operator or a user for detecting or reading an original image which is drawn by hand, or is printed by a printer, on an original (not shown). The image scanner 5 produces original-image data representing the read original image. The original-image data may be provided by a batch of bit-map data including a multiplicity of sets of bit data (i.e., picture-element data) corresponding to a multiplicity of picture elements of the original image. The processing apparatus 1 processes the original-image data, and extract therefrom original-outline data representing one or more original outlines of the original image, according to a known image-data processing algorithm. In the case of an alphabet capital letter "L" shown in FIG. 14, the processing apparatus 1 produces original-outline data representing one original outline, $P_1$–$P_7$, of the original image, i.e., original embroidery pattern shown in FIG. 5. In the case of a Japanese 'katakana' letter " " shown in FIG. 12A, the processing apparatus 1 produces original-outline data representing two original outlines, $P_1$–$P_5$ and $R_1$–$R_5$, of the original embroidery pattern.

The processing apparatus 1 additionally includes a reference-vector memory which stores data indicative of a reference or "shadow" vector, U, specifying a reference direction and a reference length. The reference-vector memory may be provided by a read only memory (ROM) 11 or a random access memory 20 of a control device 30 shown in FIG. 2. The processing apparatus 1 produces, based on original-outline data and a reference vector, shadowed-pattern embroidery data needed to control the sewing machine 14 to form a shadowed embroidery pattern including an original embroidery pattern and one or more shadow embroidery patterns which is/are contiguous with the original pattern.

Figure 1A:
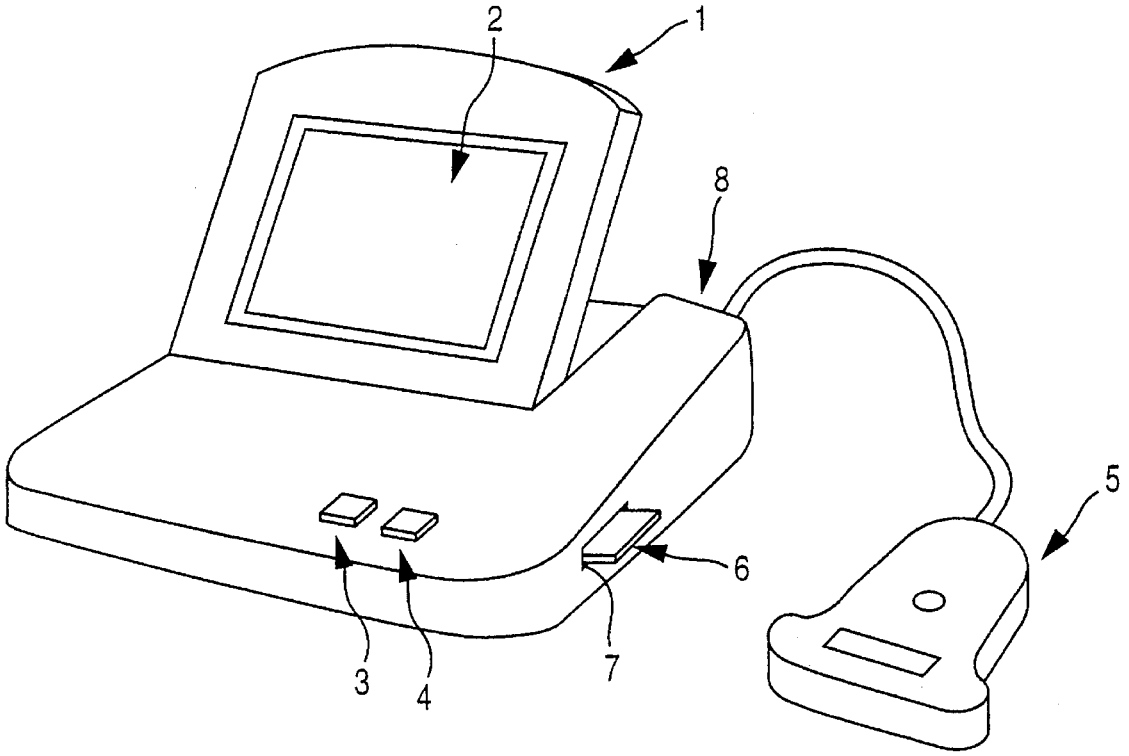
FIG. 1A is a perspective view of an embroidery data processing apparatus to which the present invention is applied.
Figure 1B:
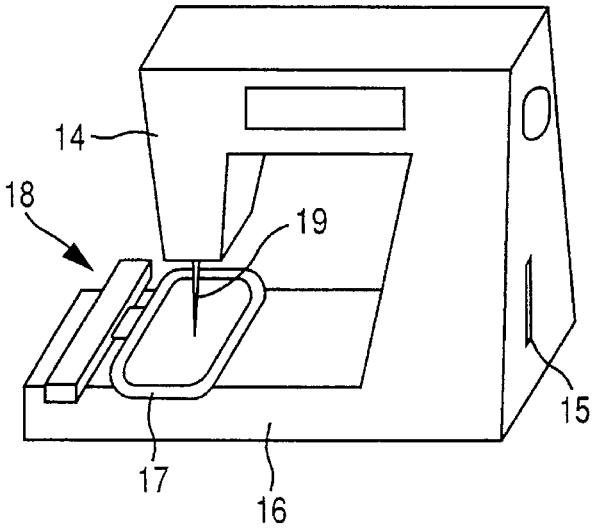
FIG. 1B is a view of a sewing machine which forms, on a work sheet, a shadowed embroidery pattern according to shadowed-pattern embroidery data produced by the processing apparatus of FIG. 1.

First, the home-use embroidery sewing machine 14 is described shortly by reference to FIG. 1B. The sewing machine 14 includes a sewing bed 16; an embroidery frame 17 provided above the sewing bed 16, for holding one or more work sheets such as fabric or leather; a moving device 18 for moving the embroidery frame 17, parallel to the sewing bed 16, to predetermined positions in an X-Y coordinate system prescribed for the sewing machine 14; and a sewing needle 19 and a shuttle device (not shown) which cooperate with each other to form stitches at the predetermined positions (i.e., stitch positions) on the work sheets while the embroidery frame 17 is moved by the moving device 18.

The sewing machine 14 additionally includes a control device (not shown) essentially provided by a microcomputer which controls the respective operations of the moving device 18, the sewing needle 19 (or needle bar to which the needle 19 is secured), and the shuttle device. According to embroidery data including sets of stitch-position data each of which represents an x-direction and a y-direction movement amount of the work sheets relative to the sewing needle 19, i.e., a stitch position where the needle 19 penetrates the work sheets to form a stitch, the control device automatically controls the stitch-forming device 18, 19 of the sewing machine 14 to form the stitches of an embroidery pattern corresponding to the embroidery data.

The sewing machine 14 includes a flash-memory device 15 into which a flash-memory card 6 on which embroidery data are recorded is inserted. The embroidery data processing apparatus 1 produces shadowed-pattern embroidery data and records them on the flash-memory card 6 which is removed from an external-memory device 7 of the processing apparatus 1 and is inserted in the flash-memory device 15 of the sewing machine 14. According to the shadowed-pattern embroidery data recorded on the memory card 6, the sewing machine 14 forms, on the work sheets held by the embroidery frame 17, a shadowed embroidery pattern corresponding to the shadowed-pattern embroidery data.

Figure 2:
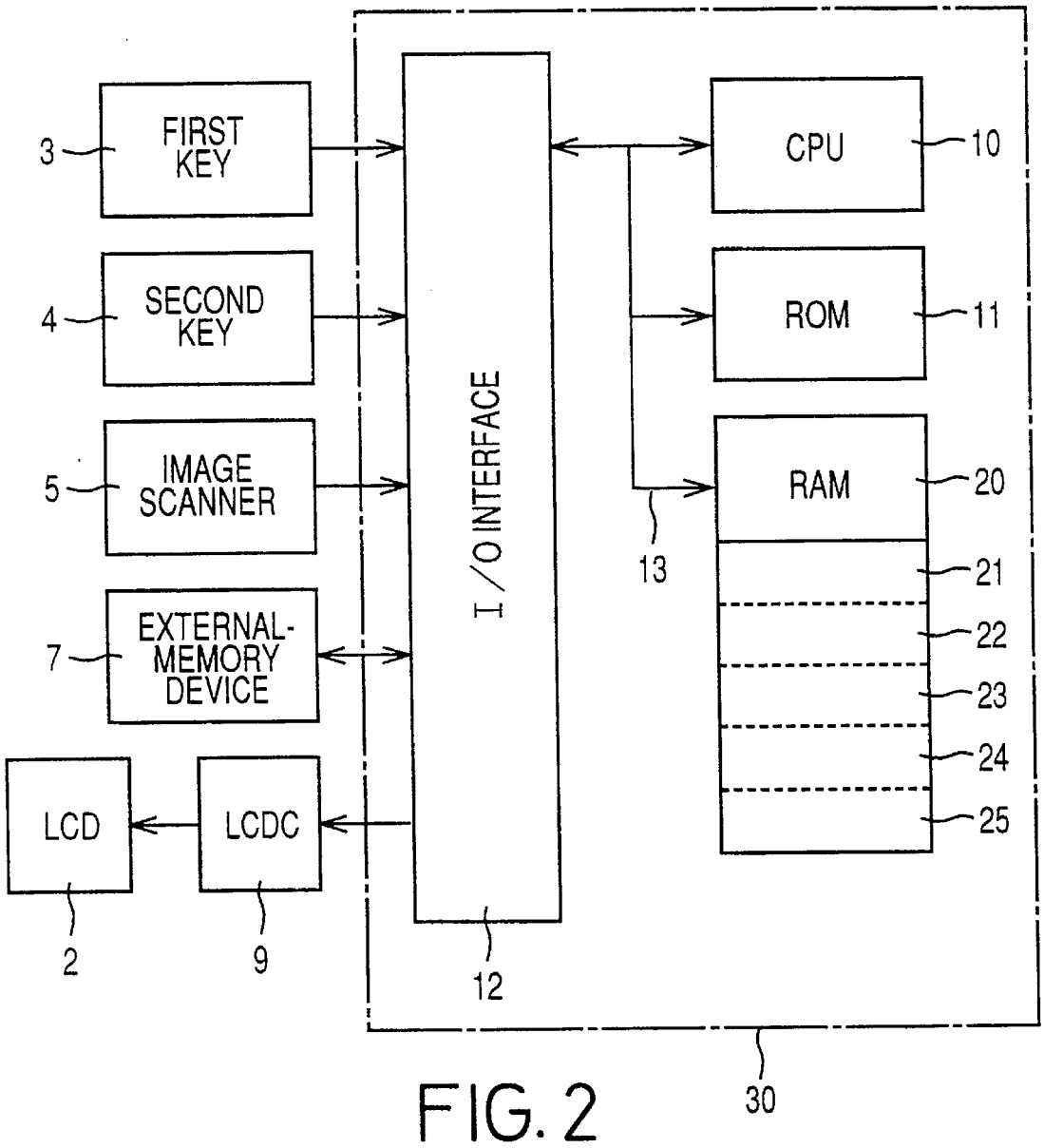
FIG. 2 is a diagrammatic view of a control device of the processing apparatus of FIG. 1.

As shown in FIG. 1A, the processing apparatus 1 includes a liquid-crystal display (LCD) 2 for displaying images and characters on a screen thereof; a first and a second operation key 3, 4 manually operable for starting the image reading of the scanner device 5 and the processing of image data obtained by the scanner device 5; the scanner device 5 for reading an original image or embroidery pattern; the external-memory device 7 for recording embroidery data on the flash-memory card 6 as a non-volatile memory; and a main control box 8 which accommodates the control device 30 to which the elements 2, 3, 4, 5, 7 are connected as shown in FIG. 2.

As shown in FIG. 2, the control device 30 includes an input and output (I/O) interface 12 to which the two operation keys 3, 4, the scanner device 5, and the external-memory device 7 are connected. In addition, an LCD controller (LCDC) 9 including a video RAM for supplying image data to the LCD 2 is connected to the I/O interface 12.

The control device 30 is essentially provided by a central processing unit (CPU) 10, and the I/O interface 12, ROM 11, and RAM 20 which are connected to the CPU 10 via bus 13 including data bus.

The scanner device 5 is provided by a 'handy' scanner which reads a monochromatic original image and produces raster-type bit-map image data including a multiplicity of sets of binary bit data each of which is indicative of a value, 0 or 1, corresponding to a white or black color of a corresponding one of a multiplicity of picture elements of the original image. The image scanner 5 is used by the user such that while a narrow portion of the scanner 5 is grasped by a hand of the user and a reading head of the scanner 5 is contacted with an original, the scanner 5 is moved relative to the original in a certain direction with a start button being pushed by a thumb or a finger of the hand. Thus, the image scanner 5 reads an original embroidery image or pattern carried on the original, and produces raster-type bit-map image data representing the original embroidery pattern. The image data thus produced are stored in an image-data memory 21 of the RAM 20.

The ROM 11 stores various control programs including a shadowed-pattern embroidery data production control program (described later) represented by the flow charts of FIGS. 3 and 4. The RAM 20 includes various memory areas including the image-data memory 21 for storing the image data obtained by the image scanner 5; an outline-data memory 22 for storing original-outline data representing one or more original outlines of the original embroidery pattern represented by the image data stored in the image-data memory 21 (the original-outline data are obtained by processing the image data); an original-pattern embroidery-data memory 23 for storing original-pattern embroidery data needed to control the sewing machine 14 to form the original embroidery pattern by fill, with stitches, a closed embroidery area, i.e., inside area bounded by the original outline or outlines thereof; a shadow-pattern embroidery data memory 24 for storing shadow-pattern embroidery data needed to control the sewing machine 14 to form one or more shadow embroidery patterns by fill, with stitches, an inside area bounded by the outline of each shadow pattern (the shadow-pattern embroidery data are automatically produced based on the original-outline data and a reference vector); and a shadowed-pattern embroidery-data memory 25 for storing shadowed-pattern embroidery data needed to control the sewing machine 14 to form a shadowed embroidery pattern including the original and shadow embroidery patterns (the shadowed-pattern embroidery data are produced based on the original-pattern embroidery data and the shadow-pattern embroidery data). The outline-data memory 22 may store original-outline data including a plurality of sets of segment data each of which represents a corresponding one of a plurality of straight and/or curved segments of an original outline of an original embroidery pattern. The shadow-pattern embroidery-data memory 24 may store shadow-pattern embroidery data which command the sewing machine 14 to form stitches of one or more shadow embroidery patterns each of which is contiguous with the original embroidery pattern and has an outline defined by one of the segments of the original outline and one or both of two straight width-defining segments which extend in a reference direction from opposite two ends of the outline segment, respectively, and each of which has a reference length defining a width of each shadow embroidery pattern in the reference direction. The reference direction and length are specified by a reference vector U.

Next, there will be described the operation of the control device 30 of the processing apparatus 1 constructed as described above, for producing shadowed-pattern embroidery data according to the control program represented by the flow charts of FIGS. 3 and 4. The following description relates to the case where shadowed-pattern embroidery data are produced for an alphabet capital letter "L" printed as an example of original embroidery pattern on an original. In particular, the manner in which shadow-pattern embroidery data are produced will be described in detail.

First, when the first key 3 is operated by the user, the control of the CPU 10 of the control device 30 begins with Step S10 at which the image scanner 5 is moved by the user from a start position on the original to read the original image or embroidery pattern and produce image data representing the read original pattern. The image thus produced are stored in the image-data memory 21.

Step S10 is followed by Step S11 to identify, based on the image data (i.e., bit-map data) stored in the memory 21, one or more original outlines of the original pattern, according to a known border-line seeking algorithm, produce original-outline data representing the identified outline or outlines, and store the original-outline data in the outline-data memory 22. The border-line seeking algorithm may employ a known four- or eight-picture-element continuity judging technique in which the CPU 10 searches four or eight picture elements continuous with an "imaged" picture element, in a predetermined order, for finding another imaged picture element, and repeats this searching step. An imaged picture element corresponds to a set of bit data representing the value of "1" (black), and an non-imaged picture element corresponds to a set of bit data representing the value of "0" (white). Based on the repeated searching steps, the CPU 10 identifies one or more outlines of the original pattern. Each outline is a closed line or loop defined by imaged picture elements continuous with one another. The CPU 10 automatically divides each original outline into a plurality of straight segments, according to a known border-line dividing algorithm. The original-outline data include a plurality of sets of segment data which define the straight segments in a predetermined order such that when the segments are traced in the predetermined order, the original embroidery pattern exists on the left-hand side of each of the segments. Each set of segment data includes two sets of point data representing opposite two end points of a corresponding straight segment. Otherwise, the user may input sets of outline-defining-point data representing outline-defining points, using a mouse and/or a keyboard (not shown), while viewing the original image being displayed on the LCD 2. The outline-defining points cooperate with each other to define the original outline.

Figure 5:
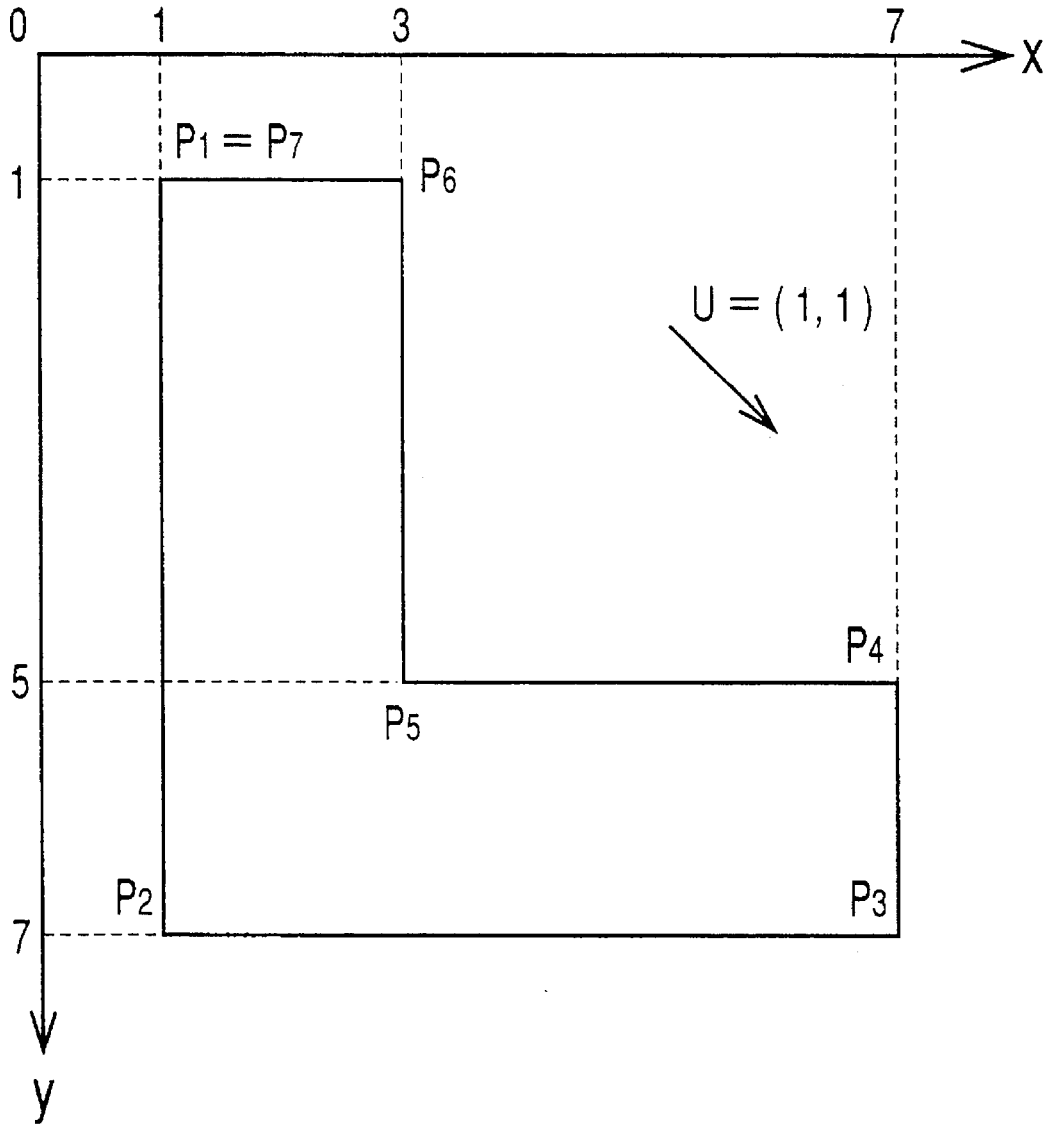
FIG. 5 is a view of an original outline of a capital letter, L, as an example of an original embroidery pattern.

For example, regarding the original embroidery pattern "L" shown in FIG. 5, the control device 30 produces original-outline data representing a single original outline defined by point $P_1$=(1, 1), point $P_2$=(1, 7), point $P_3$=(7, 7), point $P_4$=(7, 5), point $P_5$=(3, 5), point $P_6$=(3, 1), and point $P_7$ (=$P_1$)=(1, 1) arranged in the order of description, and stores the points $P_1$ to $P_7$ in the memory 22 in the same order. The first straight segment, $P_1P_2$, is represented by a set of segment data including the two sets of point data (i.e., two sets of x and y coordinate values), (1, 1) and (1, 7), and the last straight segment, $P_6P_7$, is represented by a set of segment data including the two sets of point data, (3, 1) and (1, 1).

Step S11 is followed by Step S12 to produce, based on the original-outline data, original-pattern embroidery data needed to form the stitches of the original embroidery pattern. The CPU 10 divides, according to a known block-data producing algorithm, the embroidery area bounded by the original outline, into a plurality of blocks which have quadrangular outlines and which cooperate with each other to accurately or approximately define the original outline. The CPU 10 produces sets of block data representing the respective outlines (i.e., quadrangles) of the blocks, and stores, as original-pattern embroidery data, the sets of block data in the original-pattern embroidery-data memory 23. Each set of block data includes four sets of point data (i.e., four sets of x and y coordinate values) defining the four vertices of a corresponding quadrangle. The memory 23 stores the four sets of point data of each set of block data, in a predetermined order, and the four vertices defined by the four sets of point data are called the first, second, third, and fourth point in the same order. Otherwise, the control device may produce, as original-pattern embroidery data, sets of stitch-position data which command the sewing machine 14 to form stitches filling each block such that the sewing thread conveyed by the sewing needle 19 turns around alternately on a first segment connecting between the first and third points of each block and on a second segment connecting between the second and fourth points of each block. Step S12 and a portion of the control device 30 for carrying out this step cooperate with each other to provide means for producing original-pattern embroidery data.

Figure 10:
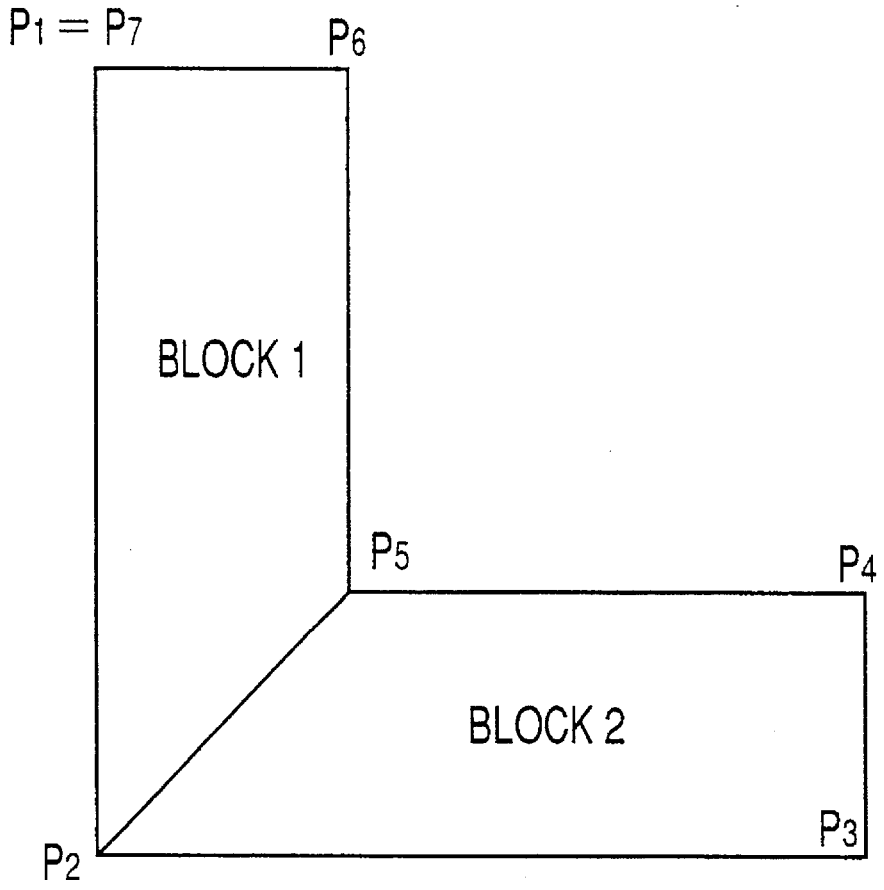
FIG. 10 is a view for illustrating an example of original-pattern embroidery data produced by the processing apparatus of FIG. 1.
Figure 10:
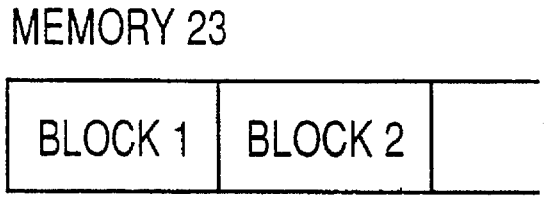

Regarding the original outline shown in FIG. 5, the control device 30 produces two sets of block data representing respective outlines of block 1 and block 2, as shown in FIG. 10. The first to fourth point of block 1 is points $P_1$, $P_6$, $P_2$, $P_5$; and the first to fourth point of block 2 is points $P_2$, $P_5$, $P_3$, $P_4$. The two sets of block data are stored in the memory 23.

Figure 4:
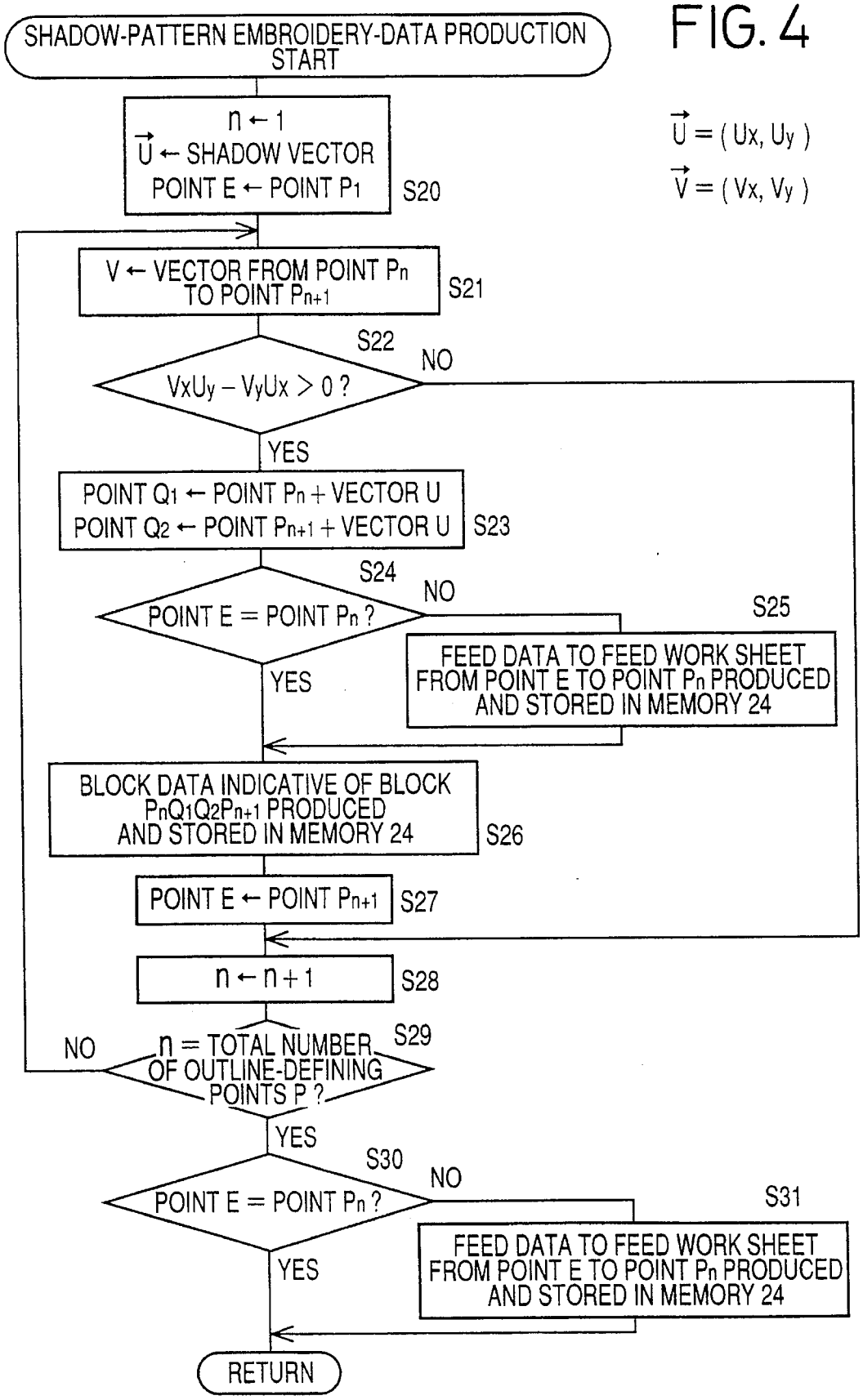
FIG. 4 is a flow chart representing a shadow-pattern embroidery-data production control sub-routine according to which the processing apparatus of FIG. 1 produces shadow-pattern embroidery data.

Step S12 is followed by Step S13, i.e., shadow-pattern embroidery-data production control sub-routine represented by the flow chart of FIG. 4. Step S13 and a portion of the control device 30 for carrying out this step cooperate with each other to provide means for producing shadow-pattern embroidery data based on original-outline data and data indicative of a reference or "shadow" vector. First, at Step S20, the CPU 10 of the control device 30 initializes a number, n, of points $P_n$ (e.g., points $P_1$ to $P_7$ specified on the original outline shown in FIG. 5), to n=1, and determines point $P_1$ as a base point, E. In addition, the CPU 10 determines a unit vector, U (=(1 ,1)), shown in FIG. 5, as a reference or "shadow" vector specifying a reference direction and a reference length. A shadow vector may be pre-stored as default data in the ROM 11; may be selected by the user using the first or second key 3, 4 from a plurality of predetermined vectors pre-stored in the ROM 11 that may be displayed on the screen of the LCD 2; or may directly be input by the user, i.e., the direction and length of the shadow vector may directly be input into the processing apparatus 1.

Step S20 is followed by Step S21 to determine a segment vector, V, starting at point $P_n$ and ending at the next point $P_{n+1}$ in the order in which points $P_1$ to $P_7$ are stored in the outline-data memory 22. In the case of n=1 on the outline shown in FIG. 5, the CPU 10 determines a segment vector V (=(0, 6)) starting at point $P_1$ and ending at point $P_2$.

Figure 6:
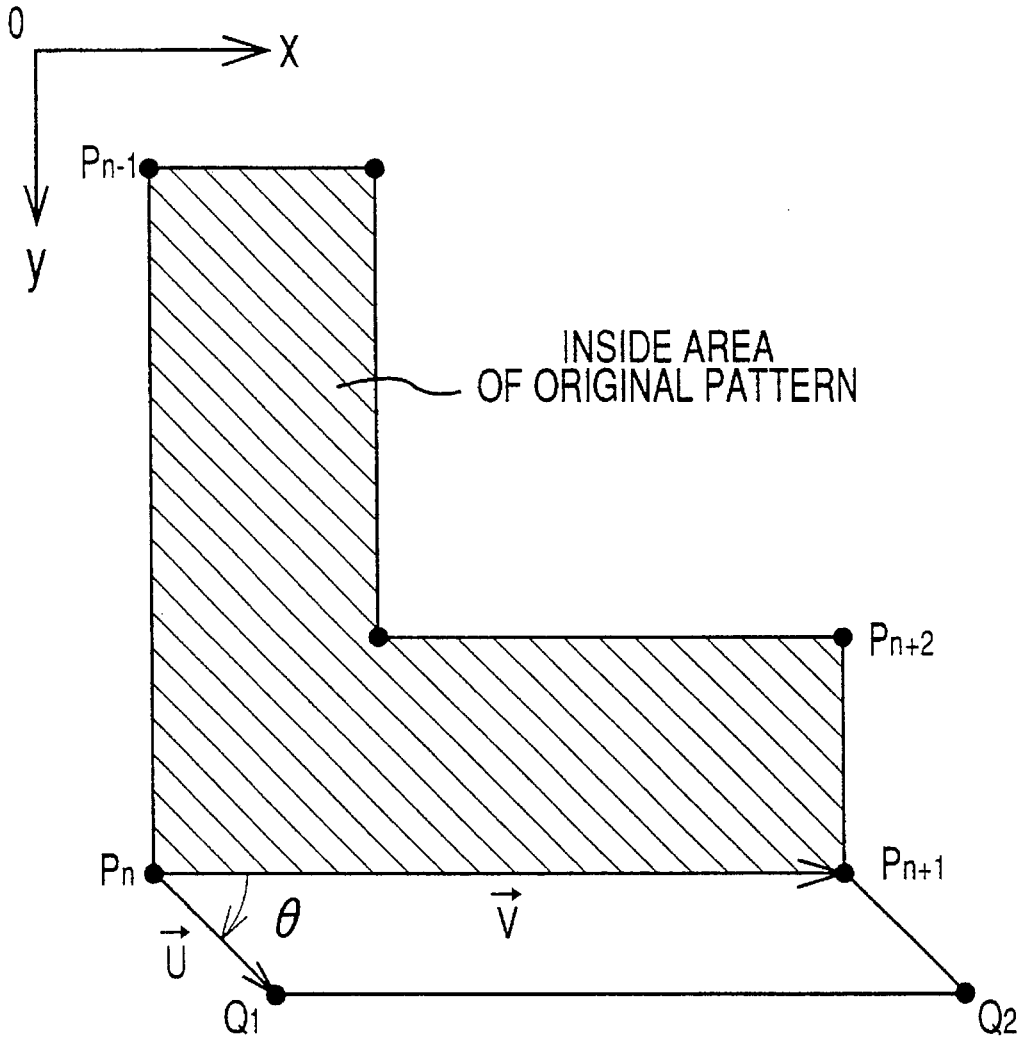
FIG. 6 is a view for illustrating the meaning of angle, θ, contained by vector V and vector U.

Step S21 is followed by Step S22 to judge whether vectors U, V satisfy the following expression: $V_xU_y-V_yU_x>0$. The mathematical meaning of this expression is as follows: As shown in FIG. 6, providing that an angle, θ, be measured from vector V to vector U in the clockwise direction, sinθ is represented by the following expression:

$$\sin\theta = \frac{U_xU_y - V_yU_x}{\sqrt{(V_x^2+V_y^2)}\ \sqrt{(U_x^2+U_y^2)}}$$

Figure 7:
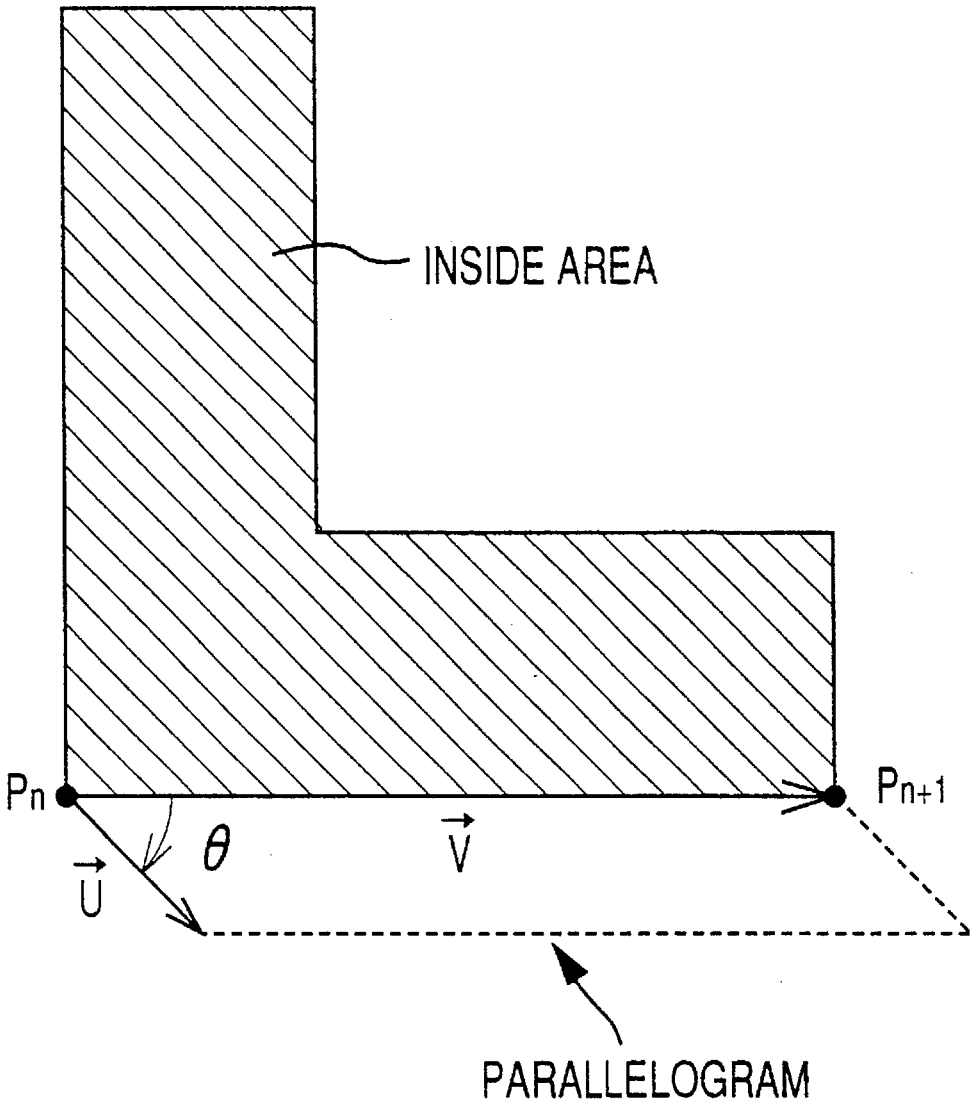
FIG. 7 is a view for illustrating the case where sin θ is greater than zero.

That is, Step S22 is provided to judge whether vectors V, U satisfy the following expression: sinθ>0. A positive judgment made at Step S22 means that, as shown in FIG. 7, shadow vector U is directed toward the right-hand side of segment vector V that is opposite to the original pattern existing on the left-hand side of vector V. In this case, the control of the CPU 10 goes to Step S23 to determine, as shown in FIG. 6, a shadow embroidery pattern which is contiguous with the original pattern and whose outline consists of a parallelogram, $P_nQ_1Q_2P_{n+1}$, defined by outline segment $P_nP_{n+1}$ and two straight width-defining segments which extend in the reference direction from opposite two end points $P_n$, $P_{n+1}$ of segment $P_nP_{n+1}$ and have the reference length defining the width of the shadow pattern in the reference direction. Point $Q_1$ is the end point of shadow vector U starting at point $P_n$, and point $Q_2$ is the end point of shadow vector U starting at point $P_{n+1}$. A set of block data representing the outline (i.e., parallelogram) of the shadow pattern is produced and stored in the shadow-pattern embroidery-data memory 24, at Step S26.

Figure 8:
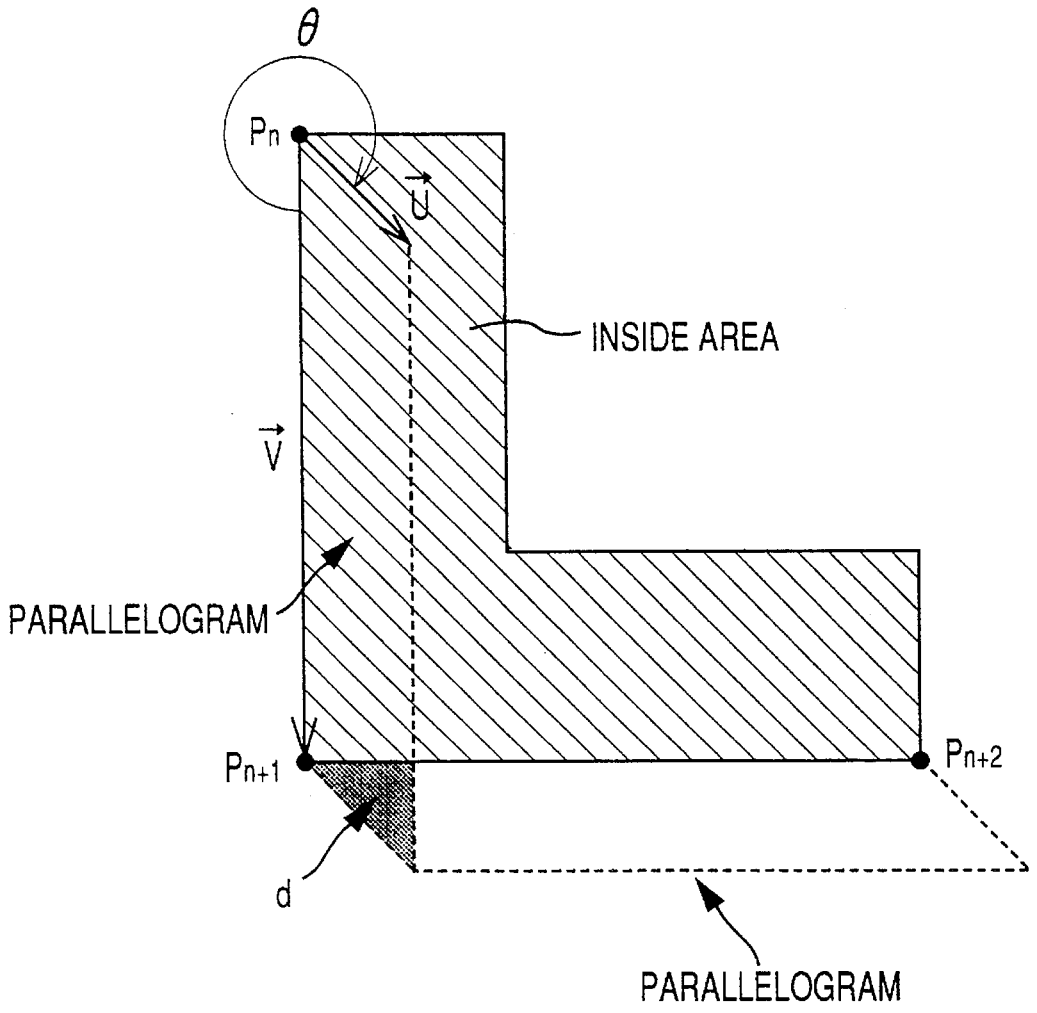
FIG. 8 is a view for illustrating the case where sin θ is not greater than zero.

On the other hand, a negative judgment made at Step S22 means that, as shown in FIG. 8, shadow vector U is directed toward the left-hand side of segment vector V where the original pattern exists. In this case, a parallelogram $P_nQ_1Q_2P_{n+1}$ substantially entirely overlaps the original pattern, and an area, d, which does not overlap the original pattern overlaps the next parallelogram $P_{n+1}Q_1Q_2P_{n+2}$ defined by the next outline segment $P_{n+1}P_{n+2}$ and shadow vector U. Therefore, in this case, a set of block data representing the parallelogram $P_nQ_1Q_2P_{n+1}$ is not produced or stored. Thus, the control of the CPU 10 goes to Step S28 to update number n to n+1 by adding one.

Step S23 is followed by Step S24 to judge whether base point E is the same as point $P_n$. For example, if, in the preceding control cycle on this routine, a negative judgment is made at Step S22 and number n is updated at Step S28, a negative judgment is made at Step S24 in the current control cycle. If a positive judgment is made at Step S24, the control directly goes to Step S26 to produce the set of block data representing the parallelogram $P_nQ_1Q_2P_{n+1}$ and store the block data in the memory 24 such that the first to fourth points of the quadrangle are points $P_n$, $Q_1$, $P_{n+1}$, $Q_2$ in the order of description, respectively. Step S26 is followed by Step S27 to update base point E to point $P_{n+1}$, and then the control goes to Step S28. On the other hand, if a negative judgment is made at Step S24, the control goes to Step S25 to produce a set of feed data to move the work sheets or the embroidery frame 17 relative to the sewing needle 19, from base point E to point $P_n$, without forming any stitches therebetween. The feed data are stored in the memory 24. Step S25 is followed by Step S26.

In the case of n=1 on the original outline shown in FIG. 5, vector V=(0, 6) is determined at Step S21, and since $V_xU_y-V_yU_x=0\cdot1-6\cdot1=-6<0$, a negative judgment is made at Step S22. Thus, the control goes to Step S28. In the case of n=2, vector V=(6, 0) is determined at Step S21, and since $V_xU_y-V_yU_x=6\cdot1-0\cdot1=6>0$, a positive judgment is made at Step S22. Since base point E=(1, 1) is not the same as point $P_2$=(1, 7), a negative judgment is made at Step S24, and the control goes to Step S25 to produce a set of feed data to move the frame 17 from base point E (=point $P_1$) to point $P_2$ and store the feed data in the shadow-pattern embroidery-data memory 24. Subsequently, the control of the CPU 10 goes to Step S26 to produce and store a set of block data representing a parallelogram $P_2Q_1Q_2P_3$, in the memory 24, and then to Step S27 to update base point E to point $P_3$.

In addition, in the case of n=3, vector V=(0, −2) is determined at Step S21, and since $V_xU_y-V_yU_x=0\cdot1-(-2)\cdot1=2>0$, a positive judgment is made at Step S22. Because of base point E=point $P_3$=(7, 7), a positive judgment is made at Step S24, and the control goes to Step S26 to produce and store a set of block data representing a parallelogram $P_3Q_1Q_2P_4$, in the memory 24, and then to Step S27 to update point E to point $P_4$.

Since the set of block data representing the quadrangle $P_nQ_1Q_2P_{n+1}$ is stored in the memory 24 such that the first, second, third, and fourth points of the quadrangle are points $P_n$, $Q_1$, $P_{n+1}$, $Q_2$, the sewing machine 14 forms, according to the block data, stitches filling the quadrangle such that the sewing thread conveyed by the sewing needle 19 turns around alternately on the first side connecting between the first and third points $P_n$, $P_{n+1}$ and on the second side connecting between the second and fourth points $Q_1$, $Q_2$. Therefore, the stitches formed in the quadrangle, i.e., shadow pattern $P_nQ_1Q_2P_{n+1}$ extend in the reference direction specified by shadow vector U. Thus, those stitches give an excellent three-dimensional effect to the stitches of the original pattern.

After number n is updated to n+1 at Step S28, the control of the CPU 10 goes to Step S29 to judge whether number n is equal to the total number of outline-defining points $P_1$–$P_7$. If a negative judgement is made at Step S29, the control goes back to Step S21 to repeat Steps S21 to S29. On the other hand, if a positive judgment is made at Step S29, the control goes to Step S30 that is the same as Step S24. If a positive judgment is made at Step S30, the control quits this sub-routine, and goes to Step S14 of the main routine of FIG. 3. On the other hand, if a negative judgment is made at Step S30, the control of the CPU 10 goes to Step S31 that is the same as Step S25. Then, the control quits this sub-routine and goes to Step S14.

Figure 9:
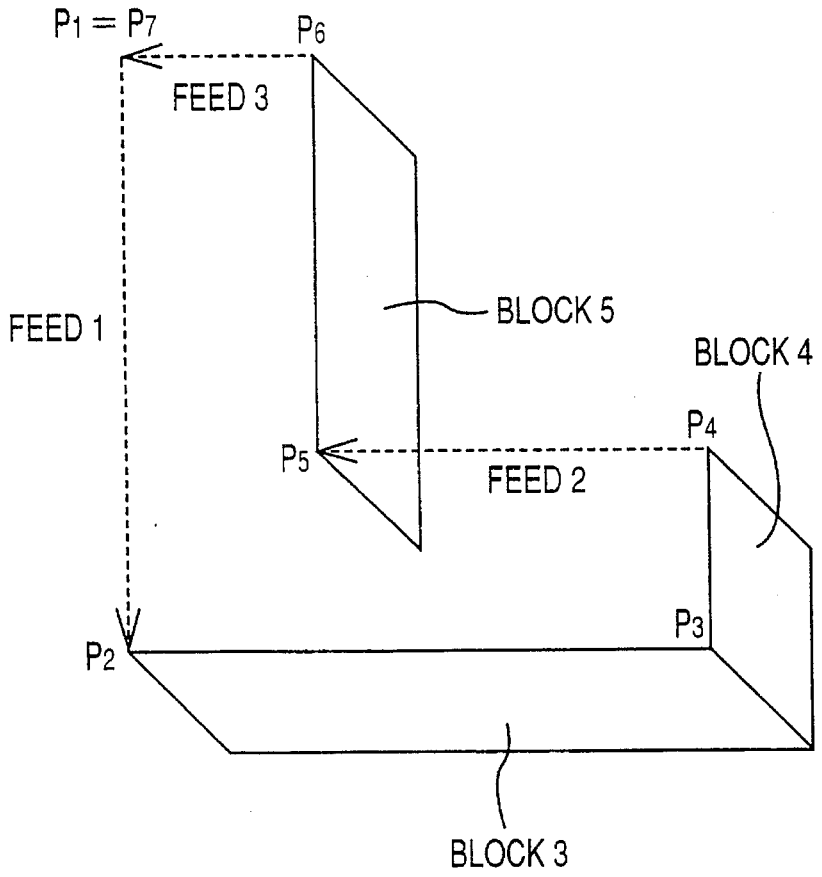
FIG. 9 is a view for illustrating an example of shadow-pattern embroidery data produced by the processing apparatus of FIG. 1.

Regarding the original outline shown in FIG. 5, the present processing apparatus 1 produces, according to the control sub-routine of FIG. 4, shadow-pattern embroidery data including three sets of block data and three sets of feed data as shown in FIG. 9, and store the embroidery data in the memory 24.

Figure 3:
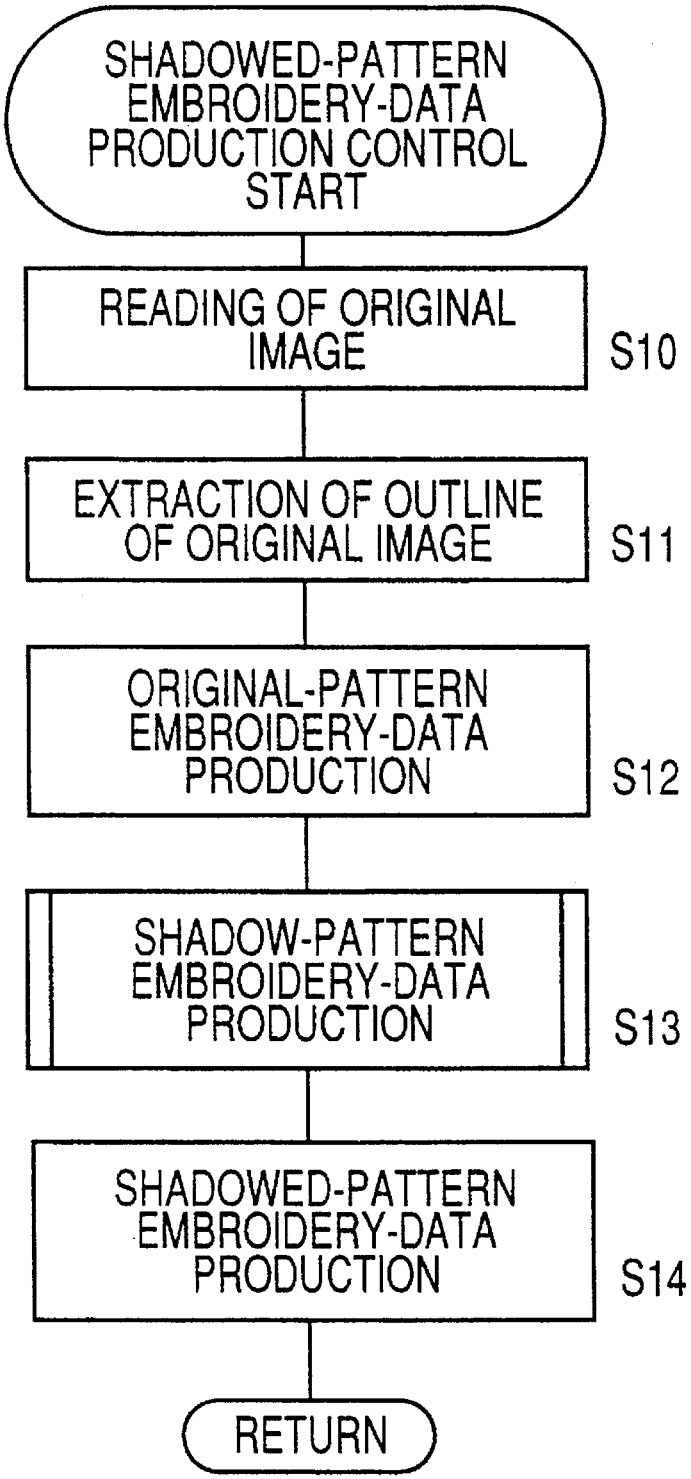
FIG. 3 is a flow chart representing a shadowed-pattern embroidery-data production control routine according to which the processing apparatus of FIG. 1 produces shadowed-pattern embroidery data.

At Step S14 of FIG. 3, the CPU 10 produces, based on the original-pattern embroidery data stored in the memory 23 and the shadow-pattern embroidery data stored in the memory 24, shadowed-pattern embroidery data needed to control the sewing machine 14 to form a shadowed embroidery pattern including the original pattern and one or more shadow patterns. The shadowed-pattern embroidery data indicates the order of sewing of the blocks corresponding to the original pattern and the blocks corresponding to the shadow patterns, such that the blocks corresponding to the shadow patterns are sewn prior to the sewing of the blocks corresponding to the original pattern. Even if a shadow pattern, e.g., block 5 shown in FIG. 9, includes an overlapping portion overlapping the original pattern, the stitches formed in the overlapping portion are fully covered by the stitches formed in the original pattern. Therefore, the embroidery product enjoys an excellent external appearance. The shadowed-pattern embroidery data are stored in the memory 25. Thus, the control in accordance with the routine of FIG. 3 is ended. In the present embodiment, Step S14 and a portion of the control device 30 for carrying out this step cooperate with each other to provide means for producing shadowed-pattern embroidery data.

Figure 11:
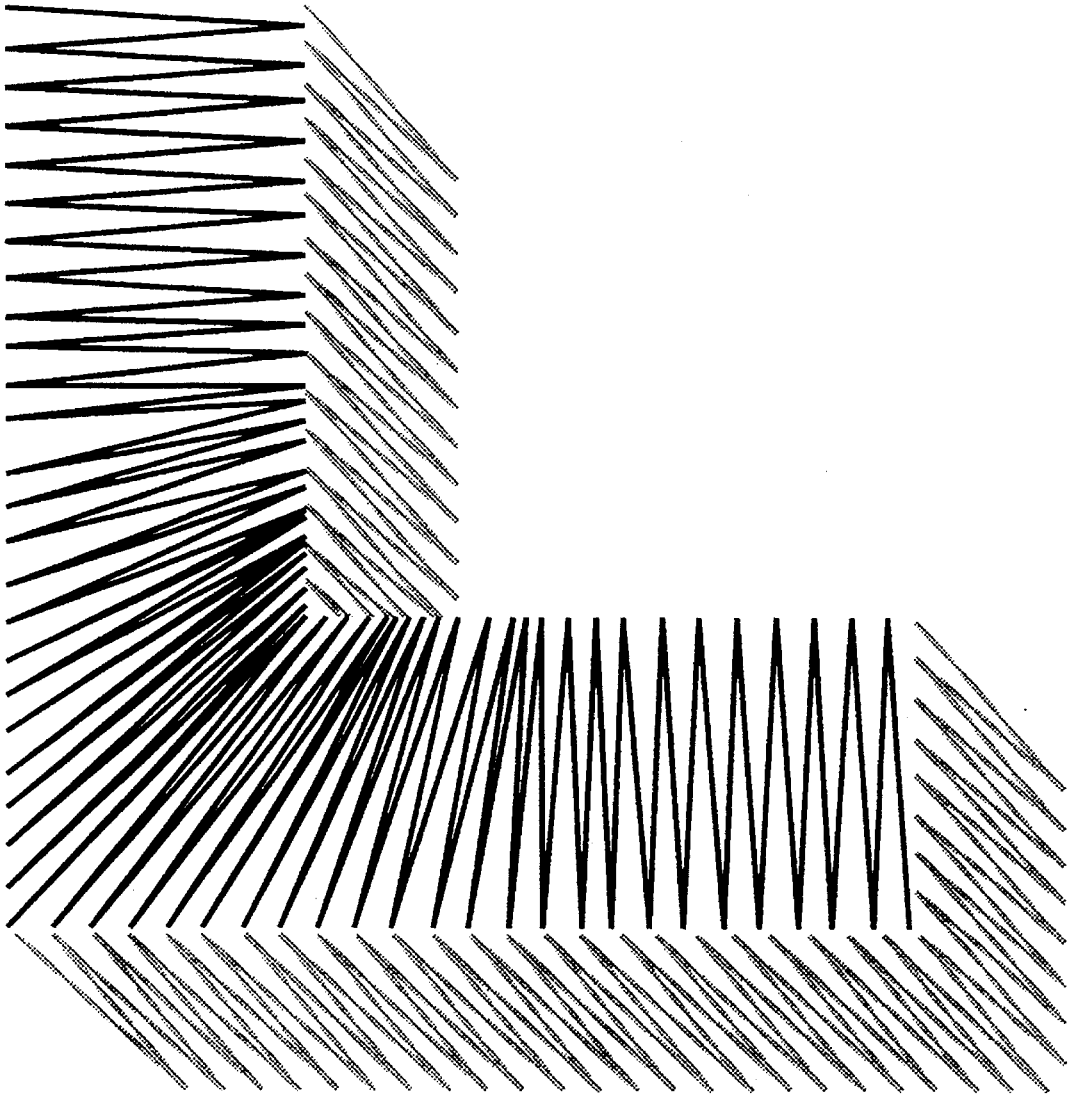
FIG. 11 is a view for illustrating an example of a shadowed embroidery pattern formed by the sewing machine of FIG. 1B according to the shadowed-pattern embroidery data produced by the processing apparatus of FIG. 1.

FIG. 11 shows stitches of a shadowed embroidery pattern formed by the sewing machine 14 according to the shadowed-pattern embroidery data produced by the processing apparatus 1 based on the reference or shadow vector U and the original outline $P_1$–$P_7$ shown in FIG. 5 and recorded on the flash-memory card 6. Step S14 may be modified such that the control device 30 produces shadowed-pattern embroidery data including sets of stitch-position data which command the sewing machine 14 to form stitches at respective stitch positions represented by the sets of stitch-position data and thereby produce a shadowed embroidery pattern as shown in FIG. 11. In the latter case, the control device 30 may be programmed to produce shadowed-pattern embroidery data which command the sewing machine 14 to form stitches of a shadowed embroidery pattern such that the stitches formed in an original pattern extend in a direction or directions different from the direction in which the stitches formed in a shadow pattern or patterns extend.

At Step S14, the control device 30 may search, based on the original outline data stored in the memory 22 and the sets of block data (i.e., block-outline-defining data) stored in the memory 24, the shadow patterns for finding an overlapping shadow pattern including an overlapping portion overlapping the original pattern. If the overlapping shadow pattern is found, the control device 30 modifies the set of block data representing the outline of the overlapping shadow pattern or block, into a modified set of block data representing an outline of a modified block which does not include the overlapping portion. In the latter case, the control device 30 does not have to take into consideration the order of sewing of the blocks corresponding to the original pattern and the blocks corresponding to the shadow patterns. That is, the blocks corresponding to the original pattern may be sewn prior to the sewing of the blocks corresponding to the shadow patterns.

Figure 12A:
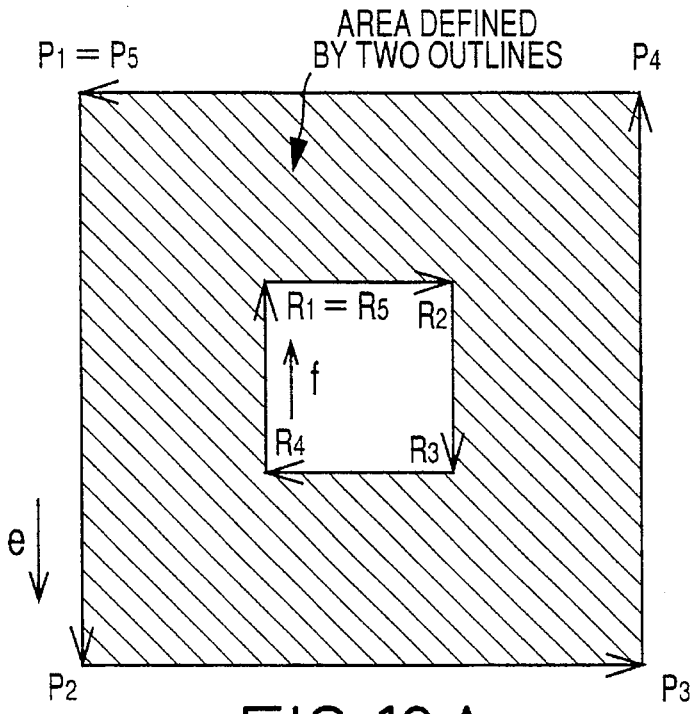
FIG. 12A is a view of an example of an original embroidery pattern having two original outlines defining a generally doughnut-like embroidery area.
Figure 12B:
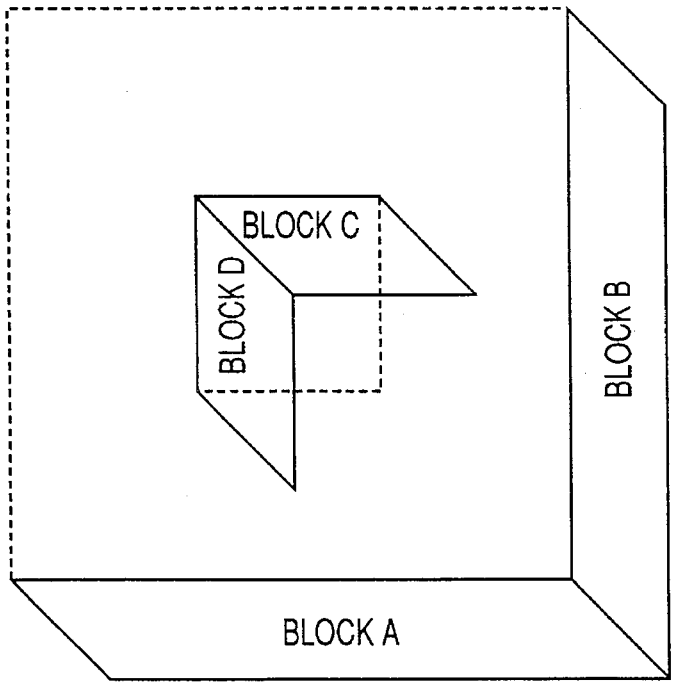
FIG. 12B is a view of shadow embroidery patterns formed contiguously with the original embroidery pattern of FIG. 12A.

Also for a generally doughnut-like original embroidery pattern having two original outlines as shown in FIG. 12A, the present processing apparatus 1 can produce shadowed-pattern embroidery data according to the control programs shown in FIGS. 3 and 4. Two sets of original-outline data representing the outer outline, $P_1$–$P_5$, and the inner outline, $R_1$–$R_5$, are stored in the outline-data memory 22. In this case, too, each set of original-outline data includes a plurality of sets of segment data which define the straight segments in a predetermined order such that when the segments are traced in the predetermined order, the original embroidery pattern exists on the left-hand side of each of the segments. Accordingly, the segments of the outer outline $P_1$–$P_5$ are traced in a direction indicated at arrow, e, and the segments of the inner outline $R_1$–$R_5$ are traced in a direction indicated at arrow, f. The processing apparatus 1 produces sets of block data representing parallelogram blocks, A and B, based on the original-outline data for the outer outline, and produces sets of block data representing parallelogram blocks, C and D, based on the original-outline data for the inner outline.

However, original-outline data may be used which include a plurality of sets of segment data which define straight or curved segments in a different order such that when the segments are traced in that order, an original embroidery pattern exists on the right-hand side of each of the segments. In the latter case, for example, the control device 30 judges, at Step S22 of FIG. 4, whether an angle θ measured from vector V to shadow vector U in a counterclockwise direction falls within the range of 0 to 180 degrees, and produces, when a positive judgment is made, shadow-pattern embroidery data needed to form a shadow embroidery pattern whose outline consists a parallelogram defined by vectors V and U.

Meanwhile, in the case where an original outline includes a curved segment such as a Besier curve or a part of a circle or an ellipse, an angle measured from a tangent vector tangent to the curved segment, to shadow vector U, in a clockwise or a counterclockwise direction, changes as the point of contact moves on the curved segment. Therefore, it is important to find one or two tangent vectors each of which is tangent to the curved segment, starts from the point of contact, and extends parallel to shadow vector U. In the latter case, the control device 30 produces shadow-pattern embroidery data needed to form a shadow embroidery pattern whose outline is defined by the curved segment and the tangent vector or vectors.

As is apparent from the foregoing description, the present processing apparatus 1 automatically produces shadow-pattern embroidery data based on original-outline data and a shadow (or reference) vector, and produces shadowed-pattern embroidery data based on original-pattern embroidery data and the shadow-pattern embroidery data. The present apparatus 1 does not require the user to input shadow-outline data representing each shadow embroidery pattern contiguous with an original embroidery pattern, by means of operating, e.g., a mouse. Thus, the present apparatus 1 easily and quickly produces shadowed-pattern embroidery data.

In addition, in the shadowed embroidery pattern formed by the sewing machine 14 according to the shadowed-pattern embroidery data produced by the present apparatus 1, only a small area or areas, if any, of the shadow pattern or patterns overlap the original pattern. Moreover, the direction in which the stitches of the shadow pattern or patterns extend is different from the direction or directions in which the stitches of the original pattern extend. Thus, the quality of the embroidery product is much improved.

While the present invention has been described in its preferred embodiments, the present invention may otherwise be embodied.

For example, in the illustrated embodiments, the image scanner 5 that optically reads or detects an original image and produces image data representing the original image, is used as an element of an outline-data obtaining device which additionally includes the control device 30 for processing the image data and producing original-outline data representing the outline of the original image. Otherwise, as described previously, the user may input, into the processing apparatus 1, original-image data or original-outline data by means of operating a digitizer, a keyboard, a mouse, a display, etc. Furthermore, the processing apparatus 1 may obtain original-outline data from an external memory such as a floppy disk or a flash-memory card.

Figure 13:
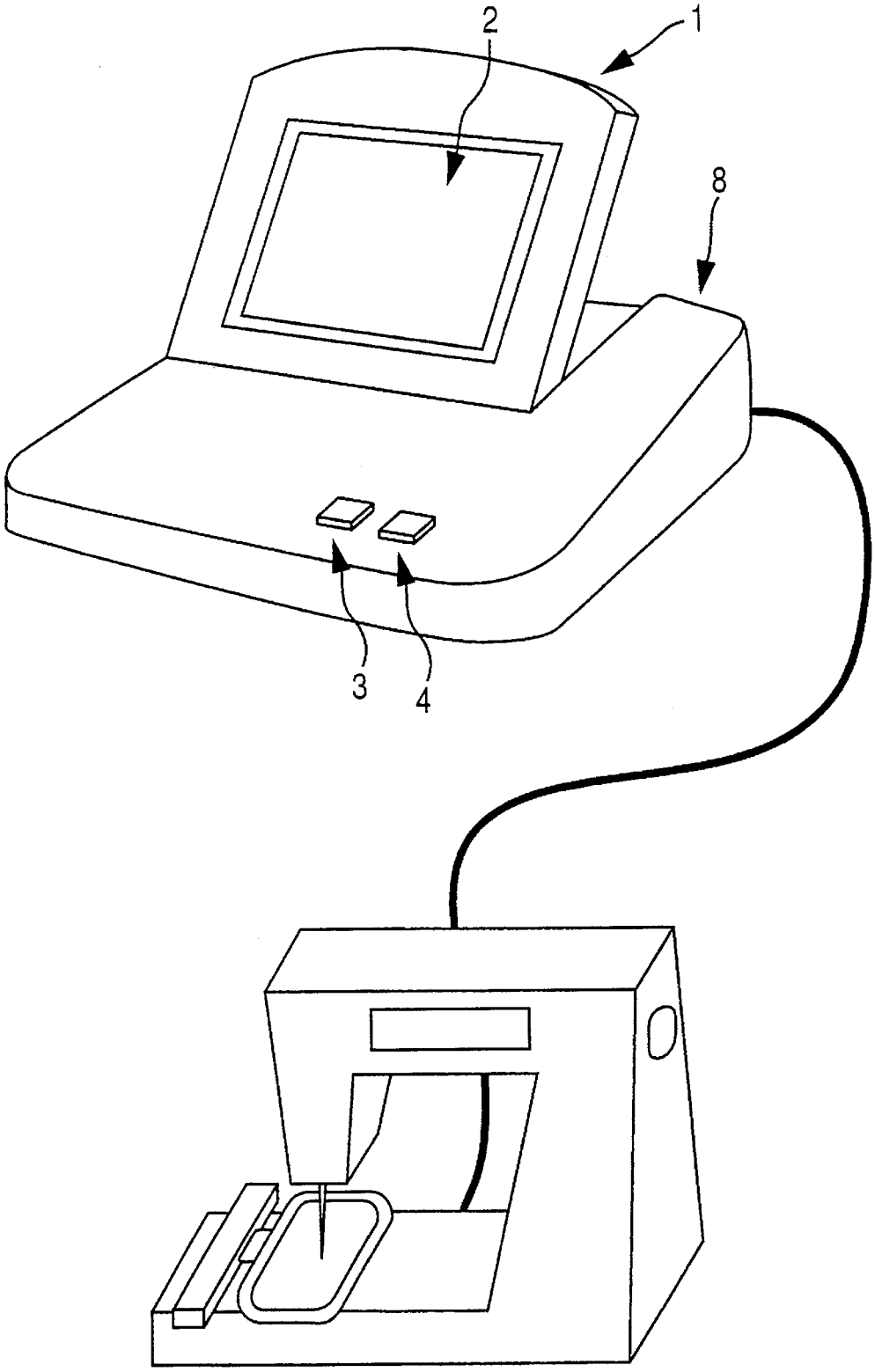
FIG. 13 is a view of an embroidery sewing system, as a second embodiment of the present invention, which includes a sewing machine and an embroidery data processing apparatus connected to the sewing machine.

Moreover, in the illustrated embodiments, the shadowed-pattern embroidery data produced by the processing apparatus 1 are recorded on the flash-memory card 6, and the card 6 is inserted in the card-reading device 15 of the sewing machine 14 so that the sewing machine 14 forms the shadowed embroidery pattern according to the embroidery data recorded on the card 6. However, as shown in FIG. 13, the processing apparatus 1 may be connected via a data cable to the sewing machine 14, so that the shadowed-pattern embroidery data produced by the processing apparatus 1 may directly be supplied from the apparatus 1 to the sewing machine 14. In the latter case, the processing apparatus 1 may, or may not, have the external-memory device 7 shown in FIG. 1A, and the sewing machine 14 may, or may not, have the card-reading device 15 shown in FIG. 1B.

The embroidery-data production control program represented by the flow charts of FIGS. 3 and 4 may be recorded in a recording medium such as a ROM card. In the latter case, the processing apparatus 1 shown in FIG. 1 reads the control program from the recording medium and uses it for producing shadowed-pattern embroidery data. The present invention also relates to the recording medium.

It is to be understood that the present invention may be embodied with other changes, improvements, and modifications that may occur to those skilled in the art without departing from the scope and spirit of the invention defined in the appended claims.

What is claimed is:

1. An apparatus for processing embroidery data needed to control a sewing machine to form an embroidery pattern on a work sheet, the apparatus comprising:

an outline-data memory which stores original-outline data representing at least one original outline of an original embroidery pattern, said original outline including a plurality of segments;

a reference-vector memory which stores data indicative of a reference vector specifying a reference direction and a reference length; and shadow-pattern embroidery-data producing means for producing, based on said original-outline data and said reference vector, shadow-pattern embroidery data needed to control the sewing machine to form stitches of at least one shadow embroidery pattern which is contiguous with the original embroidery pattern and whose outline is defined by at least one of said segments of said original outline and at least one of two straight width-defining segments which extend in said reference direction from opposite two ends of said one segment, respectively, and each of which has said reference length defining a width of the shadow embroidery pattern in said reference direction.

2. An apparatus according to claim 1, further comprising:

original-pattern embroidery-data producing means for producing, based on said original-outline data, original-pattern embroidery data needed to control the sewing machine to form the original embroidery pattern by filling, with stitches, a closed embroidery area bounded by said original outline thereof; and shadowed-pattern embroidery-data producing means for producing, based on said shadow-pattern embroidery data and said original-pattern embroidery data, shadowed-pattern embroidery data needed to form a shadowed embroidery pattern including the original and shadow embroidery patterns, such that the shadow embroidery pattern is formed prior to the formation of the original embroidery pattern.

3. An apparatus according to claim 2, wherein said shadowed-pattern embroidery-data producing means comprises means for producing said shadowed-pattern embroidery data including a plurality of sets of block data each set of which represents a quadrangle as an outline of a corresponding one of a plurality of blocks obtained by dividing the shadowed embroidery pattern including the original and shadow embroidery patterns.

4. An apparatus according to claim 2, wherein said shadowed-pattern embroidery-data producing means comprises means for producing said shadowed-pattern embroidery data including a plurality of sets of stitch-position data each set of which represents a position where a sewing needle of the sewing machine penetrates the work sheet to form a stitch of the shadowed embroidery pattern including the original and shadow embroidery patterns.

5. An apparatus according to claim 1, wherein said shadow-pattern embroidery-data producing means comprises means for producing said shadow-pattern embroidery data needed to form the stitches of the shadow embroidery pattern such that each of the formed stitches extends substantially parallel to said reference direction.

6. An apparatus according to claim 1, further comprising original-pattern embroidery-data producing means for producing, based on said original-outline data, original-pattern embroidery data needed to control the sewing machine to form stitches of the original embroidery pattern such that the stitches of the original embroidery pattern comprise stitches extending in a direction different from a direction in which the stitches of the shadow embroidery pattern extend.

7. An apparatus according to claim 1, wherein said shadow-pattern embroidery-data producing means comprises means for producing, based on said reference vector and said original-outline data representing said original outline including a straight segment as said one segment thereof, said shadow-pattern embroidery data needed to form the shadow embroidery pattern whose outline is defined by said straight segment of said original outline and said one width-defining segment.

8. An apparatus according to claim 1, wherein said shadow-pattern embroidery-data producing means comprises means for producing, based on said reference vector and said original-outline data representing said original outline including a straight segment as said one segment thereof, said shadow-pattern embroidery data needed to form the shadow embroidery pattern whose outline consists of a parallelogram defined by said straight segment of said original outline and said one width-defining segment.

9. An apparatus according to claim 1, wherein said shadow-pattern embroidery-data producing means comprises means for producing, based on said reference vector and said original-outline data representing said original outline including a curved segment as said one segment thereof, said shadow-pattern embroidery data needed to form the shadow embroidery pattern whose outline is defined by said curved segment of said original outline and said one width-defining segment.

10. An apparatus according to claim 1, wherein said shadow-pattern embroidery-data producing means comprises means for producing, based on said reference vector and said original-outline data representing said original outline including a curved segment as said one segment thereof, said shadow-pattern embroidery data needed to form the shadow embroidery pattern whose outline is defined by said curved segment of said original outline and said two width-defining segments.

11. An apparatus according to claim 1, wherein said shadow-pattern embroidery-data producing means comprises means for modifying, based on said original outline data and a shadow-outline data representing the outline of the shadow embroidery pattern, said shadow-pattern embroidery data which command the sewing machine to form the shadow embroidery pattern including an overlapping portion which overlaps the original embroidery pattern, into modified shadow-pattern embroidery data which do not command the sewing machine to form stitches in said overlapping portion.

12. An apparatus according to claim 1, wherein said outline-data memory stores said original-outline data including a plurality of sets of segment data defining, as said segments, a plurality of straight segments in an order such that when said straight segments are traced in said order, the original embroidery pattern exists on a left-hand side of each of the straight segments, and wherein said shadow-pattern embroidery-data producing means comprises judging means for judging whether an angle measured from said each straight segment to said reference vector in a clockwise direction falls within a range of 0 to 180 degrees, and means for producing, when said judging means makes a positive judgment, said shadow-pattern embroidery data needed to form the shadow embroidery pattern whose outline consists a parallelogram defined by said each straight segment and said one width-defining segment.

13. An apparatus according to claim 1, wherein said outline-data memory stores said original-outline data including a plurality of sets of segment data defining, as said segments, a plurality of straight segments in an order such that when said straight segments are traced in said order, the original embroidery pattern exists on a right-hand side of each of the straight segments, and wherein said shadow-pattern embroidery-data producing means comprises judging means for judging whether an angle measured from said each straight segment to said reference vector in a counterclockwise direction falls within a range of 0 to 180 degrees, and means for producing, when said judging means makes a positive judgment, said shadow-pattern embroidery data needed to form the shadow embroidery pattern whose outline consists a parallelogram defined by said each straight segment and said one width-defining segment.

14. An apparatus according to claim 1, wherein said outline-data memory stores said original-outline data representing said original outline including a curved segment as said one segment thereof, and wherein said shadow-pattern embroidery-data producing means comprises means for determining at least one tangent segment which is tangent to said curved segment, extends from a point on the curved segment in said reference direction, and has said reference length, and producing said shadow-pattern embroidery data needed to form the shadow embroidery pattern whose outline is defined by said curved segment and said one tangent segment.

15. An apparatus according to claim 1, wherein said shadow-pattern embroidery-data producing means comprises means for, when a shadow embroidery pattern is formed contiguously with each of a first and a third one of at least three successive segments out of said plurality of segments of said original outline and no shadow embroidery pattern is formed for a second one of said three segments which is intermediate between said first and third segments, producing said shadow-pattern embroidery data including a set of shadow-pattern connecting data needed to control the sewing machine to move at least one of a sewing needle thereof and the work sheet relative to each other, so as to connect, with a sewing thread conveyed by the sewing needle, between a position in the shadow embroidery pattern for said first segment and a position in the shadow embroidery pattern for said third segment.

16. An apparatus according to claim 2, further comprising a utilizing device which utilizes said shadowed-pattern embroidery data to control the sewing machine to form the shadowed embroidery pattern including the original and shadow embroidery patterns on the work sheet.

17. An apparatus according to claim 16, wherein said utilizing device comprises a stitch-forming device of the sewing machine which forms stitches of the shadowed embroidery pattern including the original and shadow embroidery patterns on the work sheet.

18. An apparatus according to claim 16, wherein said utilizing device comprises a data recording device which records, in an external memory, said shadowed-pattern embroidery data to control the sewing machine to form the shadowed embroidery pattern on the work sheet.

19. An apparatus according to claim 1, further comprising a data obtaining device which obtains said original-outline data and stores the obtained data in said outline-data memory.

20. An apparatus according to claim 1, further comprising a data obtaining device which obtains said data indicative of said reference vector and stores the obtained data in said reference-vector memory.

21. A process of producing an embroidery product by forming an embroidery pattern on a work sheet, the process comprising the steps of:

producing, based on original-outline data representing at least one original outline of an original embroidery pattern, and data indicative of a reference vector specifying a reference direction and a reference length, shadowed-pattern embroidery data needed to control a sewing machine to form stitches of a shadowed embroidery pattern including the original embroidery pattern and at least one shadow embroidery pattern which is contiguous with the original embroidery pattern and whose outline is defined by at least one of a plurality of segments of said original outline and at least one of two straight width-defining segments which extend in said reference direction from opposite two ends of said one segment, respectively, and each of which has said reference length defining a width of the shadow embroidery pattern in said reference direction; and operating a computer of the sewing machine to control, according to the produced shadowed-pattern embroidery data, a stitch-forming device of the sewing machine to form the stitches of the shadowed embroidery pattern on the work sheet and thereby produce the embroidery product.

22. A process according to claim 21, further comprising the step of storing, in an outline-data memory, said original-outline data representing said original outline including, as said at least one segment thereof, at least one of a straight segment and a curved segment.

23. A process according to claim 21, further comprising the step of storing, in a reference-vector memory, said data indicative of said reference vector.

24. A process according to claim 21, further comprising the step of recording said shadowed-pattern embroidery data in an external memory, and wherein the step of operating the computer of the sewing machine comprises operating the computer of the sewing machine to control, according to said shadowed-pattern embroidery data recorded in the external memory, the stitch-forming device of the sewing machine to form the stitches of the shadowed embroidery pattern on the work sheet and thereby produce the embroidery product.

25. A recording medium in which an embroidery-control program is recorded which is readable by a computer and usable to control the computer to process embroidery data according to which a sewing machine forms an embroidery pattern on a work sheet, the program comprising steps of:

obtaining original-outline data representing at least one original outline of an original embroidery pattern, said original outline including a plurality of segments;

obtaining data indicative of a reference vector specifying a reference direction and a reference length; and producing, based on said original-outline data and said reference vector, shadow-pattern embroidery data according to which the sewing machine forms stitches of at least one shadow embroidery pattern which is contiguous with the original embroidery pattern and whose outline is defined by at least one of said segments of said original outline and at least one of two straight width-defining segments which extend in said reference direction from opposite two ends of said one segment, respectively, and each of which has said reference length defining a width of the shadow embroidery pattern in said reference direction.

26. A recording medium according to claim 25, wherein the program further comprises the steps of:

producing, based on said original-outline data, original-pattern embroidery data according to which the sewing machine forms the original embroidery pattern by filling, with stitches, a closed embroidery area bounded by said original outline thereof; and producing, based on said shadow-pattern embroidery data and said original-pattern embroidery data, shadowed-pattern embroidery data according to which the sewing machine forms a shadowed embroidery pattern including the original and shadow embroidery patterns, such that the shadow embroidery pattern is formed prior to the formation of the original embroidery pattern.

27. A recording medium according to claim 26, wherein the step of producing said shadowed-pattern embroidery data comprises producing said shadowed-pattern embroidery data including a plurality of sets of block data each set of which represents a quadrangle as an outline of a corresponding one of a plurality of blocks obtained by dividing the shadowed embroidery pattern including the original and shadow embroidery patterns.

28. A recording medium according to claim 26, wherein the step of producing said shadowed-pattern embroidery data comprises producing said shadowed-pattern embroidery data including a plurality of sets of stitch-position data each set of which represents a position where a sewing needle of the sewing machine penetrates the work sheet to form a stitch of the shadowed embroidery pattern including the original and shadow embroidery patterns.

29. A recording medium according to claim 25, wherein the step of producing said shadow-pattern embroidery data comprises producing said shadow-pattern embroidery data according to which the sewing machine forms the stitches of the shadow embroidery pattern such that each of the formed stitches extends substantially parallel to said reference direction.

30. A recording medium according to claim 25, wherein the program further comprises the step of producing, based on said original-outline data, original-pattern embroidery data according to which the sewing machine form stitches of the original embroidery pattern such that the stitches of the original embroidery pattern comprise stitches extending in a direction different from a direction in which the stitches of the shadow embroidery pattern extend.

* * * * *